US008373694B2

(12) United States Patent
Kimura et al.

(10) Patent No.: US 8,373,694 B2
(45) **Date of Patent: *Feb. 12, 2013**

(54) SEMICONDUCTOR INTEGRATED CIRCUIT AND METHOD OF DRIVING THE SAME

(75) Inventors: Hajime Kimura, Kanagawa (JP); Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/214,288

(22) Filed: Aug. 22, 2011

(65) Prior Publication Data

US 2011/0298082 A1 Dec. 8, 2011

Related U.S. Application Data

(63) Continuation of application No. 12/791,533, filed on Jun. 1, 2010, now Pat. No. 8,004,513, which is a continuation of application No. 10/382,467, filed on Mar. 6, 2003, now Pat. No. 7,728,653.

(30) Foreign Application Priority Data

Mar. 6, 2002 (JP) ..... 2002-059903

(51) Int. Cl.
*G09G 5/00* (2006.01)

(52) U.S. Cl. ..... 345/211; 345/77; 345/210; 315/169.3

(58) Field of Classification Search ..... 345/76, 345/77, 82, 204–215; 315/169.1, 169.2, 315/169.3; 326/82, 83, 86; 327/108, 109, 327/261, 272, 524, 538, 540, 541

See application file for complete search history.

(56) References Cited

U.S. PATENT DOCUMENTS 3,696,393 A 10/1972 McDonald
5,594,463 A 1/1997 Sakamoto (Continued)

FOREIGN PATENT DOCUMENTS

EP 0718816 B1 6/1996
EP 1063630 A2 12/2000

(Continued)

OTHER PUBLICATIONS

International Search Report (Application No. PCT/JP03/16354) dated Mar. 9, 2004, 3 pages.

(Continued)

*Primary Examiner* — Amare Mengistu
*Assistant Examiner* — Dmitriy Bolotin
(74) *Attorney, Agent, or Firm* — Fish & Richardson P.C.

(57) ABSTRACT

A transistor causes fluctuation in the threshold and mobility due to the factor such as fluctuation of the gate length, the gate width, and the gate insulating film thickness generated by the difference of the manufacturing steps and the substrate to be used. As a result, there is caused fluctuation in the current value supplied to the pixel due to the influence of the characteristic fluctuation of the transistor, resulting in generating streaks in the display image. A light emitting device is provided which reduces influence of characteristics of transistors in a current source circuit constituting a signal line driving circuit until the transistor characteristics do not affect the device and which can display a clear image with no irregularities. A signal line driving circuit of the present invention can prevent streaks in a displayed image and uneven luminance. Also, the present invention makes it possible to form elements of a pixel portion and driving circuit portion from polysilicon on the same substrate integrally. In this way, a display device with reduced size and current consumption is provided as well as electronic equipment using the display device.

21 Claims, 15 Drawing Sheets

U.S. PATENT DOCUMENTS

| | | | | |
|---|---|---|---|---|
| 5,657,040 | A | 8/1997 | Kanbara | |
| 5,719,589 | A | 2/1998 | Norman et al. | |
| 5,745,092 | A | 4/1998 | Ito | |
| 5,805,123 | A | 9/1998 | Satoh et al. | |
| 5,923,309 | A | 7/1999 | Ishizuka et al. | |
| 5,973,661 | A | 10/1999 | Kobayashi et al. | |
| 5,990,629 | A | 11/1999 | Yamada et al. | |
| 6,020,865 | A | 2/2000 | Okuda et al. | |
| 6,037,888 | A | 3/2000 | Nairn | |
| 6,057,183 | A | 5/2000 | Koyama et al. | |
| 6,091,203 | A | 7/2000 | Kawashima et al. | |
| 6,150,877 | A | 11/2000 | Morikawa | |
| 6,222,357 | B1 | 4/2001 | Sakuragi | |
| 6,229,506 | B1 | 5/2001 | Dawson et al. | |
| 6,268,842 | B1 | 7/2001 | Yamazaki et al. | |
| 6,310,589 | B1 | 10/2001 | Nishigaki et al. | |
| 6,331,830 | B1 | 12/2001 | Song et al. | |
| 6,339,391 | B1 | 1/2002 | Chung et al. | |
| 6,351,076 | B1 | 2/2002 | Yoshida et al. | |
| 6,369,786 | B1 | 4/2002 | Suzuki | |
| 6,465,806 | B2 | 10/2002 | Kubota et al. | |
| 6,469,405 | B1 | 10/2002 | Moya et al. | |
| 6,473,064 | B1 | 10/2002 | Tsuchida et al. | |
| 6,501,466 | B1 | 12/2002 | Yamagishi et al. | |
| 6,545,651 | B2 | 4/2003 | Nishigaki et al. | |
| 6,545,652 | B1 | 4/2003 | Tsuji | |
| 6,559,836 | B1 | 5/2003 | Mori | |
| 6,586,888 | B2 | 7/2003 | Kitahara et al. | |
| 6,590,516 | B2 | 7/2003 | Inagaki et al. | |
| 6,606,080 | B2 | 8/2003 | Mukao | |
| 6,633,284 | B1 | 10/2003 | Hanari | |
| 6,693,385 | B2 | 2/2004 | Koyama | |
| 6,747,624 | B1 | 6/2004 | Udo et al. | |
| 6,753,880 | B2 | 6/2004 | Kudo et al. | |
| 6,760,004 | B2 | 7/2004 | Koyama | |
| 6,774,574 | B1 | 8/2004 | Koyama | |
| 6,777,885 | B2 | 8/2004 | Koyama | |
| 6,777,887 | B2 | 8/2004 | Koyama | |
| 6,801,061 | B2 | 10/2004 | Cowles | |
| 6,859,193 | B1 | 2/2005 | Yumoto | |
| 6,876,345 | B2 | 4/2005 | Akimoto et al. | |
| 6,909,442 | B2 | 6/2005 | Hiyama et al. | |
| 6,914,390 | B2 | 7/2005 | Koyama | |
| 6,919,870 | B2 | 7/2005 | Fukuda | |
| 6,924,601 | B2 | 8/2005 | Date | |
| 6,927,753 | B2 | 8/2005 | Koyama et al. | |
| 6,943,760 | B2 | 9/2005 | Bae et al. | |
| 6,952,194 | B1 | 10/2005 | Yamazaki et al. | |
| 6,952,228 | B2 | 10/2005 | Yoneda et al. | |
| 6,954,035 | B2 | 10/2005 | Chien et al. | |
| 6,965,362 | B1 | 11/2005 | Ishizuka | |
| 7,122,835 | B1 | 10/2006 | Ikeda et al. | |
| 7,180,479 | B2 | 2/2007 | Kimura | |
| 7,193,591 | B2 | 3/2007 | Yumoto | |
| 7,193,619 | B2 | 3/2007 | Kimura | |
| 7,358,531 | B2 | 4/2008 | Koyama | |
| 7,379,039 | B2 | 5/2008 | Yumoto | |
| 7,388,564 | B2 | 6/2008 | Yumoto | |
| 7,575,961 | B2 | 8/2009 | Ikeda et al. | |
| 8,004,513 | B2 * | 8/2011 | Kimura et al. | 345/211 |
| 2001/0019128 | A1 | 9/2001 | Kubota et al. | |
| 2001/0035862 | A1 | 11/2001 | Nakamura et al. | |
| 2001/0048410 | A1 | 12/2001 | Nishigaki et al. | |
| 2002/0014628 | A1 | 2/2002 | Koyama | |
| 2002/0135313 | A1 | 9/2002 | Koyama | |
| 2003/0156102 | A1 | 8/2003 | Kimura | |
| 2004/0008074 | A1 | 1/2004 | Takehara et al. | |
| 2004/0232952 | A1 | 11/2004 | Kimura et al. | |
| 2004/0239607 | A1 | 12/2004 | Koyama | |
| 2004/0257356 | A1 | 12/2004 | Koyama | |
| 2008/0265786 | A1 | 10/2008 | Koyama | |

FOREIGN PATENT DOCUMENTS

| | | | |
|---|---|---|---|
| EP | 1102234 | A2 | 5/2001 |
| EP | 1130565 | A1 | 9/2001 |
| JP | 62-232827 | A | 10/1987 |
| JP | 64-042099 | A | 2/1989 |
| JP | 02-189579 | A | 7/1990 |
| JP | 04-328791 | A | 11/1992 |
| JP | 05-042488 | U | 10/1993 |
| JP | 07-036410 | B | 2/1995 |
| JP | 09-081087 | A | 3/1997 |
| JP | 09-134149 | A | 5/1997 |
| JP | 09-244590 | A | 9/1997 |
| JP | 10-083166 | A | 3/1998 |
| JP | 11-045071 | A | 2/1999 |
| JP | 11-183870 | A | 7/1999 |
| JP | 2000-081920 | A | 3/2000 |
| JP | 2000-194428 | A | 7/2000 |
| JP | 2000-267164 | A | 9/2000 |
| JP | 2000-293141 | A | 10/2000 |
| JP | 2000-353811 | A | 12/2000 |
| JP | 2000-356972 | A | 12/2000 |
| JP | 2001-005426 | A | 1/2001 |
| JP | 2001-056664 | A | 2/2001 |
| JP | 2001-056669 | A | 2/2001 |
| JP | 2001-147659 | A | 5/2001 |
| JP | 2001-195042 | A | 7/2001 |
| JP | 2001-242839 | A | 9/2001 |
| JP | 2002-062845 | A | 2/2002 |
| JP | 3287391 | B2 | 3/2002 |
| JP | 2002-207465 | A | 7/2002 |
| JP | 2002-351404 | A | 12/2002 |
| JP | 2003-066902 | A | 3/2003 |
| JP | 2003-066903 | A | 3/2003 |
| JP | 2003-066909 | A | 3/2003 |
| JP | 2003-150112 | A | 5/2003 |
| JP | 2003-195812 | A | 7/2003 |
| JP | 2004-004789 | A | 1/2004 |
| WO | WO 01/06484 | A1 | 1/2001 |
| WO | WO 01/11598 | A1 | 2/2001 |
| WO | WO 01/73736 | A1 | 10/2001 |
| WO | WO 03/038793 | A1 | 5/2003 |

OTHER PUBLICATIONS

International Preliminary Examination Report (Application No. PCT/JP03/16354) dated Apr. 20, 2004 with partial translation, 7 pages.

Reiji Hattori et al.; "Circuit Simulation of Poly-Si TFT Based Current-writing Active-Matrix Organic LED Display"; Technical Report of IEICE, ED2001-8, SDM2001-8; The Institute of Electronics, Information and Communication Engineers, pp. 7-14; 2001.

English Translation of Office Action (China Patent Application No. 03119938.0), Feb. 10, 2006, 8 pages.

Office Action (Japanese Patent Application No. 2010-263049) mailed Oct. 2, 2012 with English translation.

* cited by examiner

SEMICONDUCTOR INTEGRATED CIRCUIT AND METHOD OF DRIVING THE SAME

CROSS-REFERENCE TO RELATED APPLICATIONS

This application is a continuation of U.S. application Ser. No. 12/791,533, filed Jun. 1, 2010, now allowed, which is a continuation of U.S. application Ser. No. 10/382,467, filed Mar. 6, 2003, now U.S. Pat. No. 7,728,653, which claims the benefit of a foreign priority application filed in Japan as Serial No. 2002-059903 on Mar. 6, 2002, all of which are incorporated by reference.

BACKGROUND OF THE INVENTION

1. Field of the Invention

The present invention relates to techniques for a semiconductor integrated circuit and its driving method. The invention also relates to a light emitting device that has a semiconductor integrated circuit of the present invention in its driving circuit portion and a pixel portion, in particular, an active matrix light emitting device which has a semiconductor integrated circuit of the present invention as a signal line driving circuit in a driving circuit portion, which has a plurality of pixels arranged so as to form a matrix pattern, and which has a switching element and a light emitting element in each of the pixels.

2. Description of the Related Art

In recent years, development of light emitting devices using self-luminous light emitting elements has progressed. Making good use of advantages such as high quality image, thinness and lightweightness, such light emitting devices are widely used in display screens of mobile phones and personal computers. In particular, light emitting devices using light emitting elements are characteristic in that they have suitably fast response speed for animated displays, and low voltage and low power consumption driving. Thus, light emitting devices using light emitting elements are expected to be widely used for various purposes, including new-generation mobile telephones and personal digital assistants (PDAs) and are attracting attention as the next-generation displays.

An example of a light emitting element is an organic light emitting diode (OLED) with an anode and a cathode, and has a structure in which an organic compounded layer is sandwiched between the aforementioned anode and cathode. The organic compound layer generally has a laminate structure of which is represented by a laminate structure of "hole transport layer, light emitting layer, and electron transport layer", proposed by Tang, Eastman Kodak Company.

In order to make a light emitting element emit light, the semiconductor device which drives the light emitting element is formed of polysilicon (polycrystalline silicon) which has a large ON current. The amount of current that flows into the light emitting element and the luminescence of the light emitting element are in direct proportion to each other, whereby the light emitting element emits light having luminescence in accordance with the amount of current which flows to the organic compound layer. Also, as the semiconductor device that drives the light emitting element, a polysilicon transistor formed of polysilicon is used.

However, when displaying a multi-gray scale image using a light emitting device with a light emitting element, a method of driving the device such as an analog gray scale method (analog driving method), or a digital gray scale method (digital driving method) can be given. The difference between the two lies in their methods of controlling the light emitting element in the state of light emission or non-light emission. The former analog gray scale method uses an analog method of controlling the current that flows into the light emitting element thereby obtaining gray scale. The latter digital gray scale method uses a method in which the light emitting element is driven in only two states, an ON state (almost 100% luminescence), and an OFF state (almost 0% luminescence).

Further, proposed is a current input method with which it is possible to classify the type of signal that is inputted into the light emitting device using the light emitting element as an example. In this current input method, it is supposed control of the amount of current that flows to the light emitting element is possible without being influenced by the TFT which drives the light emitting element.

The current input method is applicable to both the analog gray scale method and the digital gray scale method mentioned above. The current input method is a method where a video signal inputted into a pixel is a current and the luminescence of the light emitting element can be controlled by flowing current according to the inputted video signal (current) into the light emitting element.

Next, an example of a circuit construction of a pixel using a current input method and a driving method thereof in light emitting device will be explained with reference to FIG. 14. In FIG. 14, a pixel has a signal line 1401, first to third scanning lines 1402 to 1404, a power source line 1405, transistors 1406 to 1409, a capacitor element 1410, and light emitting element 1411. A current source circuit 1412 is provided to the signal line.

The transistor 1406 has a gate electrode connected to the first scanning line 1402. A first electrode of the transistor 1406 is connected to the signal line 1401 whereas its second electrode is connected to a first electrode of the transistor 1407, a first electrode of the transistor 1408, and a first electrode of the transistor 1409. The transistor 1407 has a gate electrode connected to the second scanning line 1403. A second electrode of the transistor 1407 is connected to a gate electrode of the transistor 1408. A second electrode of the transistor 1408 is connected to the current line 1405. The transistor 1409 has a gate electrode connected to the third scanning line 1404. A second electrode of the transistor 1409 is connected to one of electrodes of the light emitting element 1411. The capacitor element 1410 is connected between the gate electrode and second electrode of the transistor 1408 to hold the gate-source voltage of the transistor 1408. The current line 1405 and a cathode of the light emitting element 1411 receive given electric potentials to hold an electric potential difference with each other.

Operations from video signal writing to light emission will be described next. First, pulses are inputted to the first scanning line 1402 and the second scanning line 1403 to turn the transistors 1406 and 1407 ON. A signal current flowing in the signal line 1401 at this point is denoted by $I_{data}$ and is supplied from the current source circuit 1412.

Right after the transistor 1406 is turned ON, no electric charges are held in the capacitor element 1410 yet and therefore the transistor 1408 remains OFF. In other words, a current caused by electric charges accumulated already in the capacitor element 1410 alone is flowing at this point.

Thereafter, electric charges are gradually accumulated in the capacitor element 1410 to cause a difference in electric potential between the electrodes. As the electric potential difference between the electrodes reaches a threshold Vth of the transistor 1408, the transistor 1408 is turned ON to generate a current flow. The current flowing into the capacitor element 1410 then is gradually reduced. However, the reduced current does not stop ongoing accumulation of electric charges in the capacitor element 1410.

Accumulation of electric charges in the capacitor element 1410 continues until the electric potential difference between its two electrodes, namely, the gate-source voltage of the transistor 1408, reaches a given voltage, which is a voltage ($V_{GS}$) high enough to cause the current $I_{data}$ to flow in the transistor 1408. When the accumulation of electric charges is finished, the current $I_{data}$ continues to flow in the transistor 1408. A signal writing operation is conducted as above. Lastly, the first scanning line 1402 and the second scanning line 1403 stop being selected to turn the transistors 1406 and 1407 OFF.

A light emission operation follows next. A pulse is inputted to the third scanning line 1404 to turn the transistor 14090N. With the transistor 1408 turned ON by $V_{GS}$ which is written in the preceding operation and kept in the capacitor 1410, a current flows from the current source line 1405. This causes the light emitting element 1411 to emit light. If the transistor 1408 is set to operate in a saturation range at this point, a light emission current $I_{EL}$ flowing in the light emitting element 1411 does not deviate from $I_{data}$ even when the source-drain voltage of the transistor 1408 is changed.

As described above, the current input method refers to a method in which a drain current whose current value is equal to or in proportion to the signal current value set by the current source circuit 1412 flows between the source and drain of the transistor 1408 and the light emitting element 1411 emits light with a luminance according to the drain current. By employing a current input method pixel as the one described in the above, influence of fluctuation in characteristic between transistors that constitute the pixel can be reduced and a desired current can be supplied to its light emitting element. Other current input method pixel circuits have been reported in U.S. Pat. No. 6,229,506 B1 and JP 2001-147659 A.

In a light emitting device employing the current input method, a signal current exactly reflecting a video signal has to be inputted to a pixel. However, when polysilicon transistors are used to build a driving circuit that inputs a signal current to a pixel (the circuit corresponds to the current source circuit 1412 in FIG. 14), characteristic fluctuation between the polysilicon transistors leads to fluctuation in signal current and unevenness in an image displayed. The characteristic fluctuation is caused by defects in crystal growth direction and grain boundaries, nonuniformity in thickness of the laminate; and insufficient accuracy in patterning a film. Because of large fluctuation between the polysilicon transistors, it is difficult to generate an accurate signal current and an image displayed will be full of streaks running vertically.

In other words, influence of characteristic fluctuation between transistors constituting a driving circuit that inputs a signal current to a pixel has to be reduced in a light emitting device employing the current input method. This means that influence of characteristic fluctuation has to be reduced both in transistors that constitute the driving circuit and in transistors that constitute a pixel.

SUMMARY OF THE INVENTION

The present invention has been made in view of the above problems, and an object of the present invention is therefore to provide a semiconductor integrated circuit which reduces influence of transistor characteristic fluctuation between current sources of a current source circuit until the transistor characteristics do not affect the circuit, as well as a method of driving the semiconductor integrated circuit.

Another object of the present invention is to provide a light emitting device having a driving circuit portion that has the semiconductor integrated circuit and a pixel portion.

Particularly, an object of the present invention is to provide an active matrix light emitting device which has the semiconductor integrated circuit as a signal line driving circuit in a driving circuit portion, which has a plurality of pixels arranged so as to form a matrix pattern, and which has a switching element and a light emitting element in each of the pixels.

Another object of the present invention is to provide a light emitting device in which semiconductor elements of a pixel portion and driving circuit portion are composed of polysilicon thin film transistors to integrally form the pixel portion and the driving circuit portion on the same substrate.

A current source circuit is composed of one or more current sources. One current source has one or more transistors. A current source that supplies a constant current is called a constant current source.

A semiconductor integrated circuit of the present invention is characterized by having signal lines, a current source circuit that outputs a current to be inputted to the signal lines, and means for switching current source circuits connected to the signal lines each time a given period passes (hereinafter simply referred to as switching means. The switching means has a plurality of circuits that have a switching function, and therefore is also called a switching circuit).

The switching means of the present invention switches current sources connected to signal lines and accordingly switches currents inputted to the signal lines at given intervals even when there is fluctuation in current outputted from the current source circuit. Therefore, the amount of current flowing into a light emitting element, namely, the luminance, is seemingly evened out over time and display unevenness can be solved. A light emitting device that is not influenced by transistor characteristic fluctuation is thus provided.

DETAILED DESCRIPTION OF THE PREFERRED EMBODIMENTS

Embodiment Mode

An outline of a semiconductor integrated circuit of the present invention, as a signal line driving circuit, will be described with reference to FIG. 6. For easy understanding, FIG. 6 focuses on three current sources C(i), C(i+1), and C(i+2) of a current source circuit and on a signal line S(m) for supplying a current to a pixel.

Figure 6:
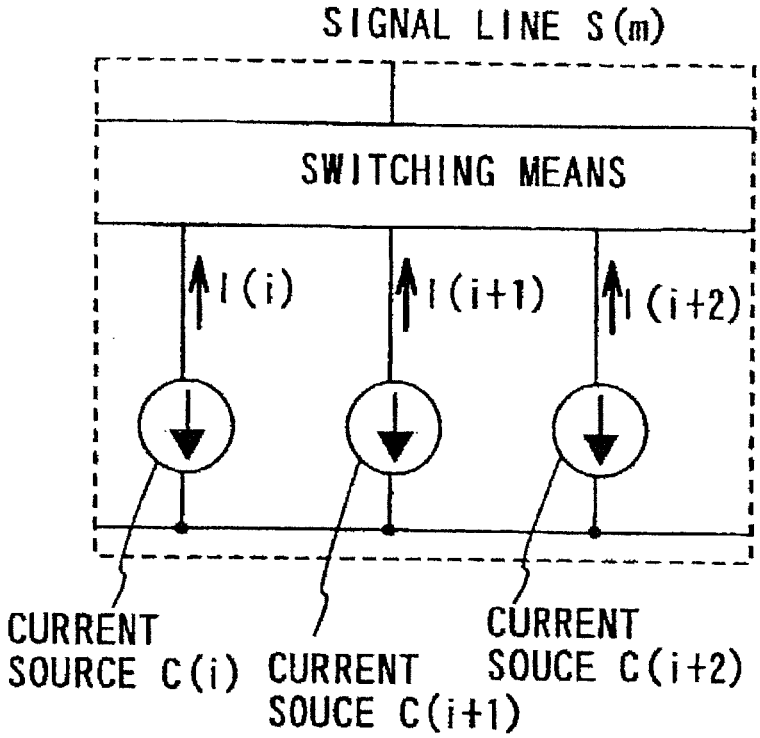
FIG. 6 is a diagram showing the structure of a semiconductor integrated circuit of the present invention.

As shown in FIG. 6, the current sources C(i), C(i+1), and C(i+2) are connected to the signal line S(m) through switching means. The present invention is characterized in that the switching means chooses a current to be inputted to the signal line S(m) out of a current I(i), a current I(i+1), and a current I(i+2) from the three current sources C(i) to C(i+2) and switches from one current to another each time a given period passes.

Figure 7:
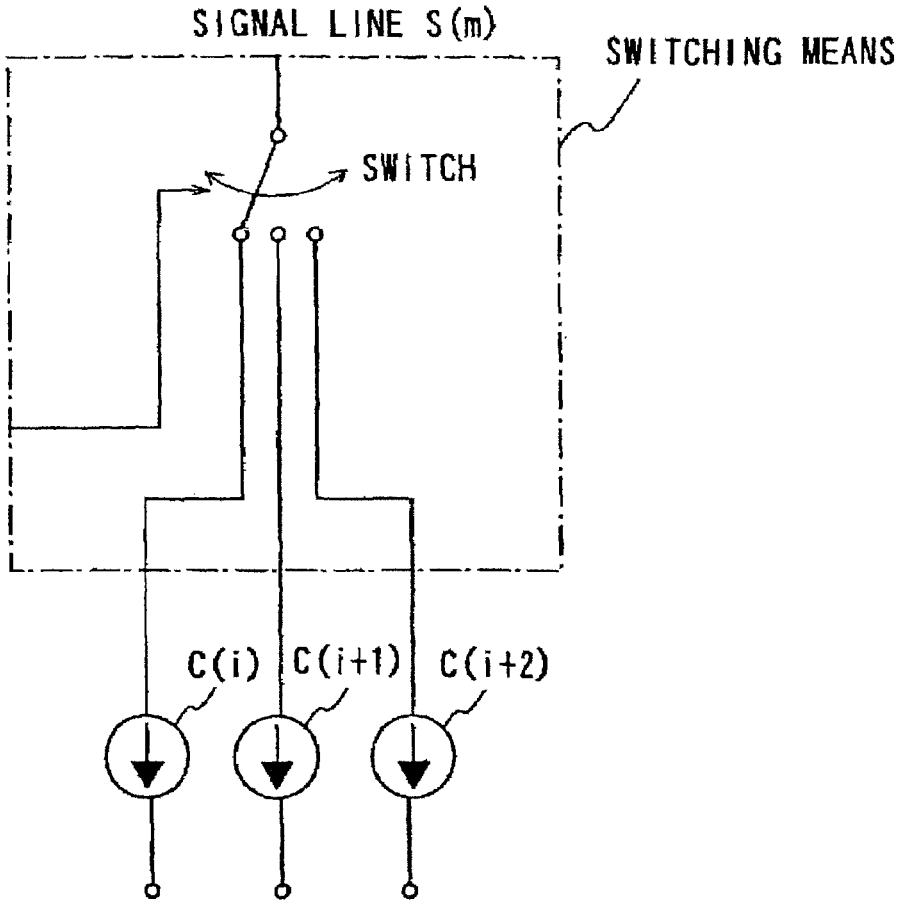
FIG. 7 is a diagram showing the structure of switching means in a semiconductor integrated circuit of the present invention.

The switching means is described next. FIG. 7 shows the structure of the switching means. The current sources C(i), C(i+1), and C(i+2) respectively have characteristics that make the currents I(i), I(i+1), and I(i+2) to flow. The current sources C(i), C(i+1), and C(i+2) are placed such that they can be connected to the signal line S(m) through a switch. A signal is inputted to the switch and, according to the signal, the switch connects the signal line S(m) to one of the current sources C(i), C(i+1), and C(i+2).

When the switch establishes a connection with the current source C(i), the current I(i) flows into the signal line S(m). When the switch establishes a connection with the current source C(i+1), the current I(i+1) flows into the signal line S(m). When the switch connects with the current source C(i+2), the current I(i+2) flows into the signal line S(m). In short, the current to be flown into the signal line S(m) is switched among I(i), I(i+1), and I(i+2).

The example illustrated by FIGS. 6 and 7 focuses on one signal line and three current sources for easy understanding. However, an actual signal line driving circuit has plural signal lines and current sources as shown in the following embodiments. The switch serving as the switching means in FIG. 7 has a terminal but, in practice, the switching function is provided by an analog switch or like other circuits as shown in the following embodiments.

A period, for switching within this given period is very short. Therefore, an image displayed seems uniform to the human eye even when there is difference in characteristics between current sources, namely, fluctuation in current supplied from a current source.

With the switching means described above, the present invention obtains a semiconductor integrated circuit having a current source circuit which is not influenced by transistor characteristics. This makes it possible to provide a light emitting device which can supply a desired signal current to a light emitting element and which can display an image with no unevenness.

To generalize the present invention using a function, the present invention is a semiconductor integrated circuit, comprised of: m signal lines $S_1, S_2, \ldots,$ and $S_m$; a current source circuit that has i current sources $C_1, C_2, \ldots,$ and $C_i$; and switching means that includes n switching units $U_1, U_2, \ldots,$ and $U_n$, the circuit characterized in that: the n switching units are each connected to j current sources out of the i current sources; and the M-th signal line $S_M$ is connected to the N-th switching unit $U_N$, and the switching unit $U_N$ is connected to the $F_1(N)$-th current source, the $F_2(N)$-th current source, the $F_3(N)$-th current source, . . . , and the $F_j(N)$-th current source which satisfy a function $F_k(x)$ (k=1~j, x=1−n).

The present invention is a semiconductor integrated circuit, comprised of: m signal lines $S_1, S_2, \ldots,$ and $S_m$; a current source circuit that has i current sources $C_1, C_2, \ldots,$ and $C_i$; and switching means that includes n switching units $U_1, U_2, \ldots,$ and $U_n$, the circuit characterized in that: the n switching units are each connected to j current sources out of the i current sources; the M-th signal line $S_M$ is connected to the N-th switching unit $U_N$, and the switching unit $U_N$ is connected to the $F_1(N)$-th current source, the $F_2(N)$-th current source, the $F_3(N)$-th current source, . . . , and the $F_j(N)$-th current source which satisfy a function $F_k(x)$ (k=1~j, x=1~n); and the (M−1)-th signal line $S_{M-1}$ is connected to the (N−1)-th switching unit $U_{N-1}$, and the switching unit $U_{N-1}$ is connected to the $F_1(N-1)$-th current source, the $F_2(N-1)$-th current source, the $F_3(N-1)$-th current source, . . . , and the $F_j(N-1)$-th current source which satisfy the function $F_k(x)$.

In the present invention, adjacent switching units can share a current source. Using the above function, this is expressed as the current sources satisfying F3(N)=F2(N+1)=F1(N+2) when i=3, for example. In other words, adjacent switching units can share the N-th current source, the (N+1)-th current source, and the (N+2)-th current source. To give another example, current sources satisfy F5(N)=F4(N+1)=F3(N+2)=F4(N+3)=F5(N+4) when i=5, and adjacent switching units can share the N-th, (N+1)-th, (N+2)-th, (N+3)-th, and (N+4)-th current sources.

As described, the present invention allows switching units to share current sources. This eliminates the border between one signal line and its adjacent signal line and makes a uniform current to flow in all signal lines. As a result, no border is formed in any part of the display screen to make it possible to provide a light emitting device with no streaks in a displayed image and no luminance unevenness.

The present invention solves characteristic fluctuation among elements used in a semiconductor integrated circuit, and can provide the same effect when the elements whose characteristic fluctuation is to be controlled are transistors other than polysilicon transistors, for example, single crystal silicon transistors.

Embodiment 1

In this embodiment, a semiconductor integrated circuit of the present invention is applied to a signal line driving circuit of a driving circuit portion and a specific description is given on a structure and driving method of a current source circuit of the signal line driving circuit.

Figure 1:
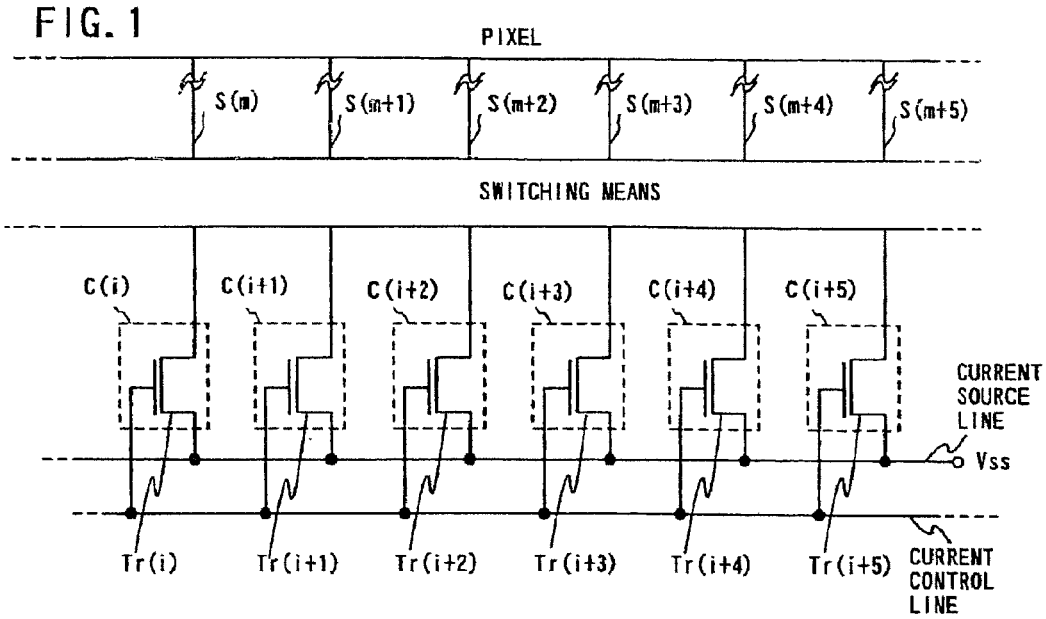
FIG. 1 is a diagram showing the structure of a semiconductor integrated circuit of the present invention.

A specific example of the present invention is shown in FIG. 1. The description given in this embodiment deals with current sources constituted of n-channel transistors. A transistor can take either the n-channel polarity or the p-channel polarity and, commonly, the polarity of a transistor is determined by the polarity of a pixel. When a current flows from a pixel toward a current source circuit, the polarity is desirably the n type. When a current flows from a current source circuit to a pixel, the polarity is desirably the p type. This is because fixing the source electric potential of a transistor is convenient.

Shown in FIG. 1 are transistors Tr(i) to Tr(i+5), switching means, and signal lines S(m) to S(m+5). The transistors Tr(i)

to Tr(i+5) constitute current sources C(i) to C(i+5), respectively. Gate electrodes of the transistors Tr(i) to Tr(i+5) are connected to a current control line and their source electrodes are connected to $V_{SS}$. The current value is controlled by the voltage applied to the current control line.

The gate electrodes of the transistors Tr(i) to Tr(i+5) here are connected to the same current control line for simplification. However, the transistors may be connected to different current control lines to have different current values by applying different levels of voltage to the current control lines. In this case, different transistors output currents to different destinations and voltages applied to the current control lines have to be switched in accordance with a switch in destination.

If the transistors Tr(i) to Tr(i+5) have an identical characteristic, currents I(i) to I(i+5) are equal to one another. In reality, however, characteristic fluctuation among the transistors Tr(i) to Tr(i+5) is large and therefore the currents I(i) to I(i+5) are varied. The switching means of the present invention chooses a current to be inputted to a signal line out of the currents I(i) to I(i+5) and switches from one to another each time a given period passes. Accordingly, a current flowing in a light emitting element is also switched at given intervals. As a result, to the human eye, light emission is evened out over time and unevenness in luminance is reduced.

Figure 2:
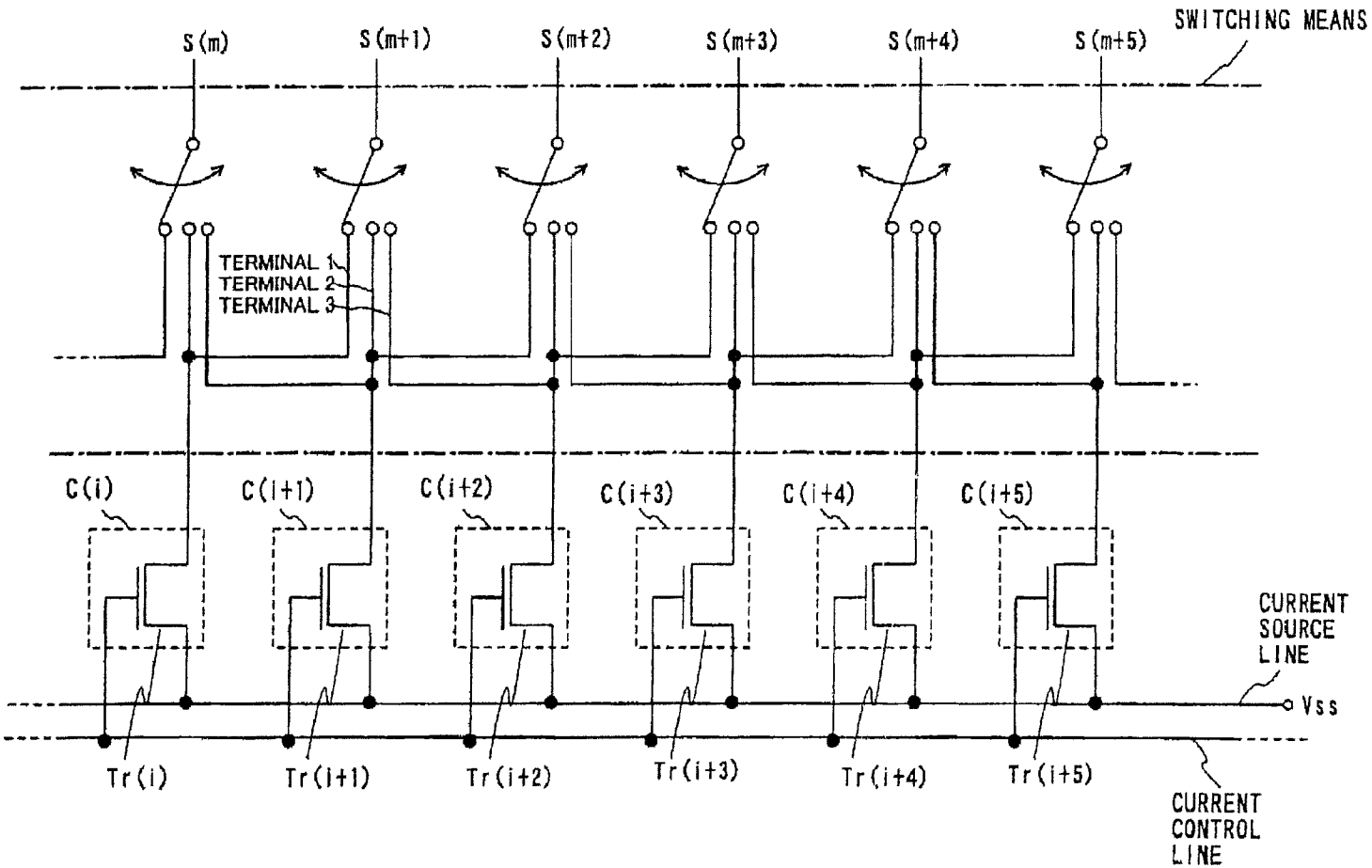
FIG. 2 is a diagram showing the structure of a semiconductor integrated circuit of the present invention.

FIG. 2 shows the structure of the switching means having analog switches (also called transfer gates). In FIG. 2, components identical with those in FIG. 1 are denoted by the same symbols. The circuit is designed such that drain electrodes of the transistors Tr(i) to Tr(i+5) are connected to the signal lines S(m) to S(m+5). However, one signal line can be connected to three current sources. By a switching function, one out of three current sources is chosen for one signal line.

For example, when a signal for selecting a terminal 1 is inputted to the switching means, the signal line S(m+1) is connected to the current source C(i), the signal line S(m+2) is connected to the current source C(i+1), and the subsequent signal lines and current sources are connected in a similar fashion. Next, a signal for selecting a terminal 2 is inputted to the switching means to connect the signal line S(m+1) to the current source C(i+1) and the signal line S(m+2) to the current source C(i+2), and the subsequent signal lines and current sources are connected in a similar fashion. Next, a signal for selecting a terminal 3 is inputted to the switching means to connect the signal line S(m+1) to the current source C(i+2) and the signal line S(m+2) to the current source C(i+3), and the subsequent signal lines and current sources are connected in a similar fashion. Currents from three current sources are thus alternately inputted to one signal line, thereby avoiding uneven display.

To generalize this connection using the function that expresses the present invention, the current sources are set so as to satisfy F1(N)=N+a, F2(N)=N+b, and F3(N)=N+c (a, b, and c are integers and a≠b≠c) when i=3, and a=−1, b=0, and c=1.

Figure 3:
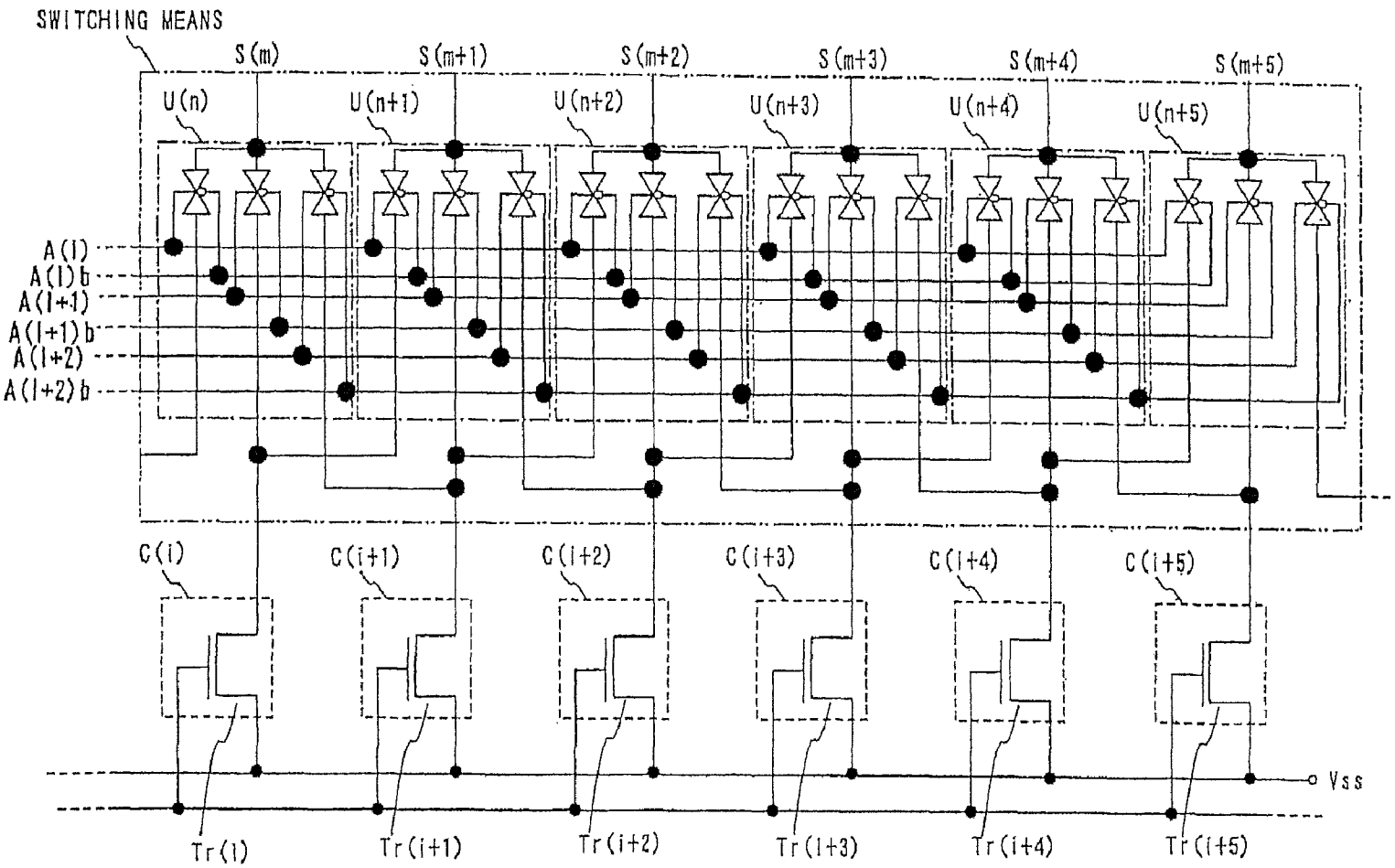
FIG. 3 is a diagram showing the structure of a semiconductor integrated circuit of the present invention.

FIG. 3 shows a specific example in which analog switches are used for the switching means having a switching function. In FIG. 3, components identical with those in FIG. 2 are denoted by the same symbols, and the current sources C(i) to C(i+5) have the transistors Tr(i) to Tr(i+5), respectively.

Denoted by A(l) to A(l+2) and A(l)b to A(l+2)b in FIG. 3 are wires connected to plural analog switches. The analog switches are divided into groups and a group of analog switches is connected to one signal line (switching unit). In FIG. 3, switching units U(n) to U(n+5) each have three analog switches and are connected to the signal lines S(m) to S(m+5), respectively. The switching units together form the switching means.

In the current source C(i+1), the drain electrode of the transistor Tr(i+1) is connected to one of the analog switches of the switching unit U(n+1), one of the analog switches of the switching unit U(n), and one of the analog switches of the switching unit U(n+2). In short, a drain electrode of a transistor is connected to one analog switch chosen from each of three switching units. The rest of the current sources, C(i), C(i+2), C(i+3), C(i+4), and C(i+5), are similarly connected to their respective analog switches.

When signals are inputted to the wires A(l) and A(l)b, an analog switch to be connected is chosen and turned conductive. Then a current flows from the current source connected with the selected analog switch to a signal line, for example, from the current source C(i+1) to the signal line S(m+2). Similarly, currents flow from the current sources C(i+1), C(i+3), C(i+4), C(i+5), and C(i+6) to the signal lines S(m), S(m+2), S(m+3), S(m+4), and S(m+5), respectively. This is referred to as Selection (1).

Next, signals are inputted to the wires A(l+1) and A(l+1)b and an analog switch to be connected is chosen and turned conductive. Then a current flows from the current source connected with the selected analog switch to a signal line, for example, from the current source C(i+1) to the signal line S(m+1). Similarly, currents flow from the current sources C(i+1), C(i+3), C(i+4), C(i+5), and C(i+6) to the signal lines S(m+1), S(m+3), S(m+4), S(m+5), and S(m+6), respectively. Though not shown in FIG. 3, the current source C(i+6) is the current source to the right of the current source C(i+5). This is referred to as Selection (2).

Next, signals are inputted to the wires A(l+2) and A(l+2)b and an analog switch to be connected is chosen to turn it conductive. Then a current flows from the current source connected with the selected analog switch to a signal line, for example, from the current source C(i+1) to the signal line S(m). Similarly, currents flow from the current sources C(i+1), C(i+3), C(i+4), C(i+5), and C(i+6) to the signal lines S(m−1), S(m+1), S(m+2), S(m+3), and S(m+4), respectively. Though not shown in FIG. 3, the signal line S(m−1) is the signal line to the left of the signal line S(m). This is referred to as Selection (3).

Selections (1) to (3) are repeated at given intervals. In this way, an image displayed is made seemingly uniform even when the current inputted from the current sources C(i) to C(i+5) to the signal lines S(m) to S(m+5) is fluctuated.

Figure 4:
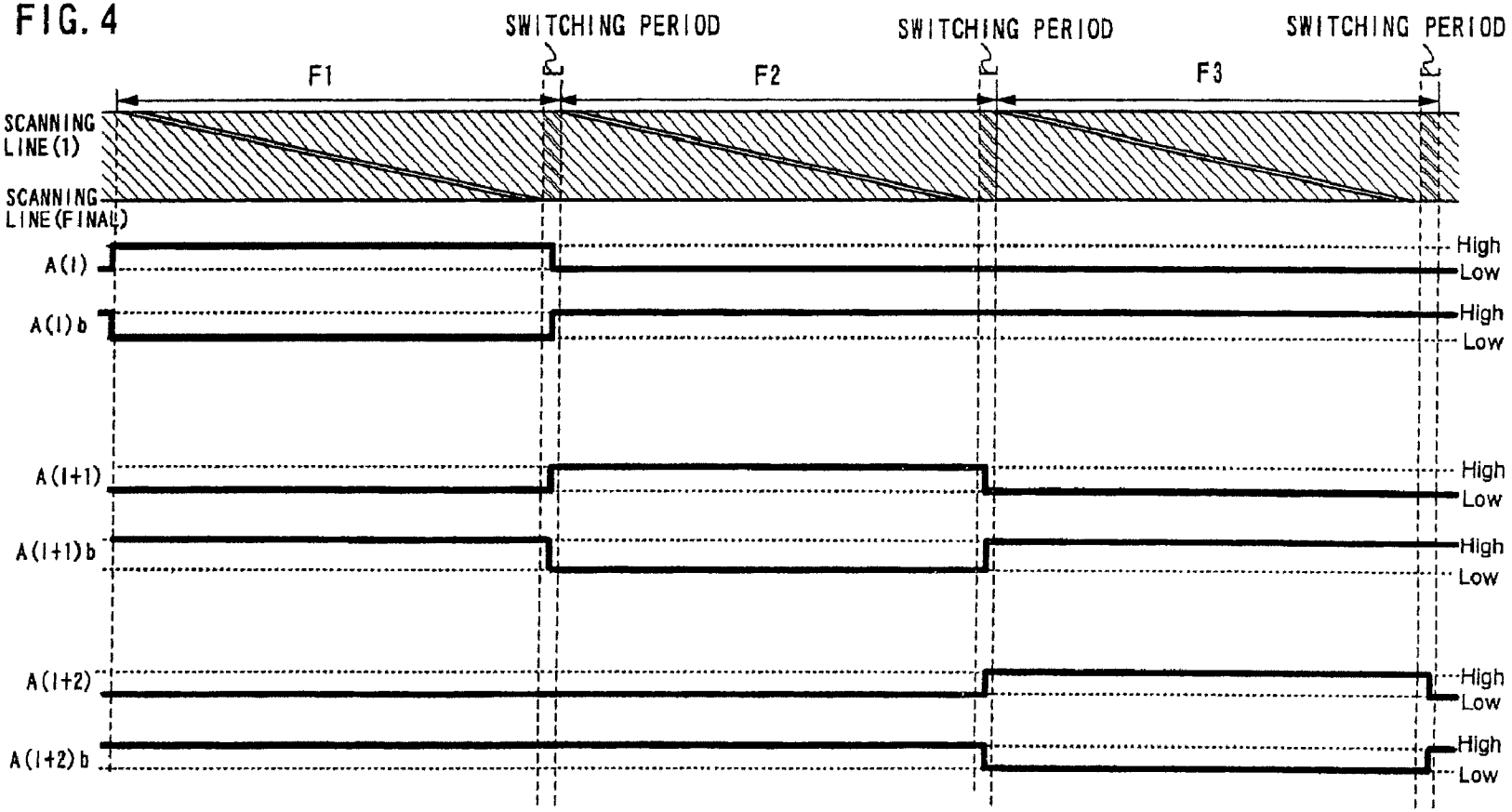
FIG. 4 is a timing chart of a signal line driving method of the present invention.

The switching period in the signal line driving circuit of the present invention is described with reference to a timing chart of FIG. 4. F1 to F3 in FIG. 4 denote first to third frame periods, respectively, and it takes one frame period for a light emitting device to display one image. One frame period is usually set to about 1/60 second in order to prevent flicker from being recognized by the human eye. A(l) to A(l+2) and A(l)b to A(l+2)b in FIG. 4 represent electric potentials of signals inputted to the wires A(l) to A(l+2) and A(l)b to A(l+2)b.

A switching period in which the electric potential of a signal inputted to A(l) is High (H) and the electric potential of a signal inputted to A(l)b is Low (L) is set in the first frame period F1. In this switching period, analog switches that are connected to the wires A(l) and A(l)b are turned conductive and currents are inputted from the transistors that are connected with the now-conductive analog switches to signal lines. Accordingly, only one analog switch out of each switching unit is turned conductive.

A switching period in which the electric potential of a signal inputted to A(l+1) is High (H) and the electric potential of a signal inputted to A(l+1)b is Low (L) is set in the second frame period F2. In this switching period, analog switches that are connected to the wires A(l+1) and A(l+1)b are turned conductive, and currents are inputted from the transistors that are connected with the now-conductive analog switches to signal lines.

A switching period in which the electric potential of a signal inputted to A(l+2) is High (H) and the electric potential of a signal inputted to A(l+2)b is Low (L) is set in the third frame period F3. In this switching period, analog switches that are connected to the wires A(l+2) and A(l+2)b are turned conductive and currents are inputted from the transistors that are connected with the now-conductive analog switches to signal lines.

The frame periods F1 to F3 are repeated to allow the switching means to switch currents flowing into the signal lines S(m) to S(m+5) in order.

The description given in this embodiment deals with a structure in which the power supply line connected to a current source having an n type transistor is Vss and a current flows from a pixel to Vss. However, the polarity of the transistor is set in accordance with the polarity of the pixel as mentioned above. Accordingly, if the circuit takes a structure in which a current flows toward a pixel, the power supply line is Vdd and the transistor of the current source is given the p type conductivity.

Described next is a case in which a current source has a DA conversion function. This current source makes a current source circuit that outputs a current having analog values of 8 gray scales when a 3-bit digital video signal is inputted, for example.

Figure 5:
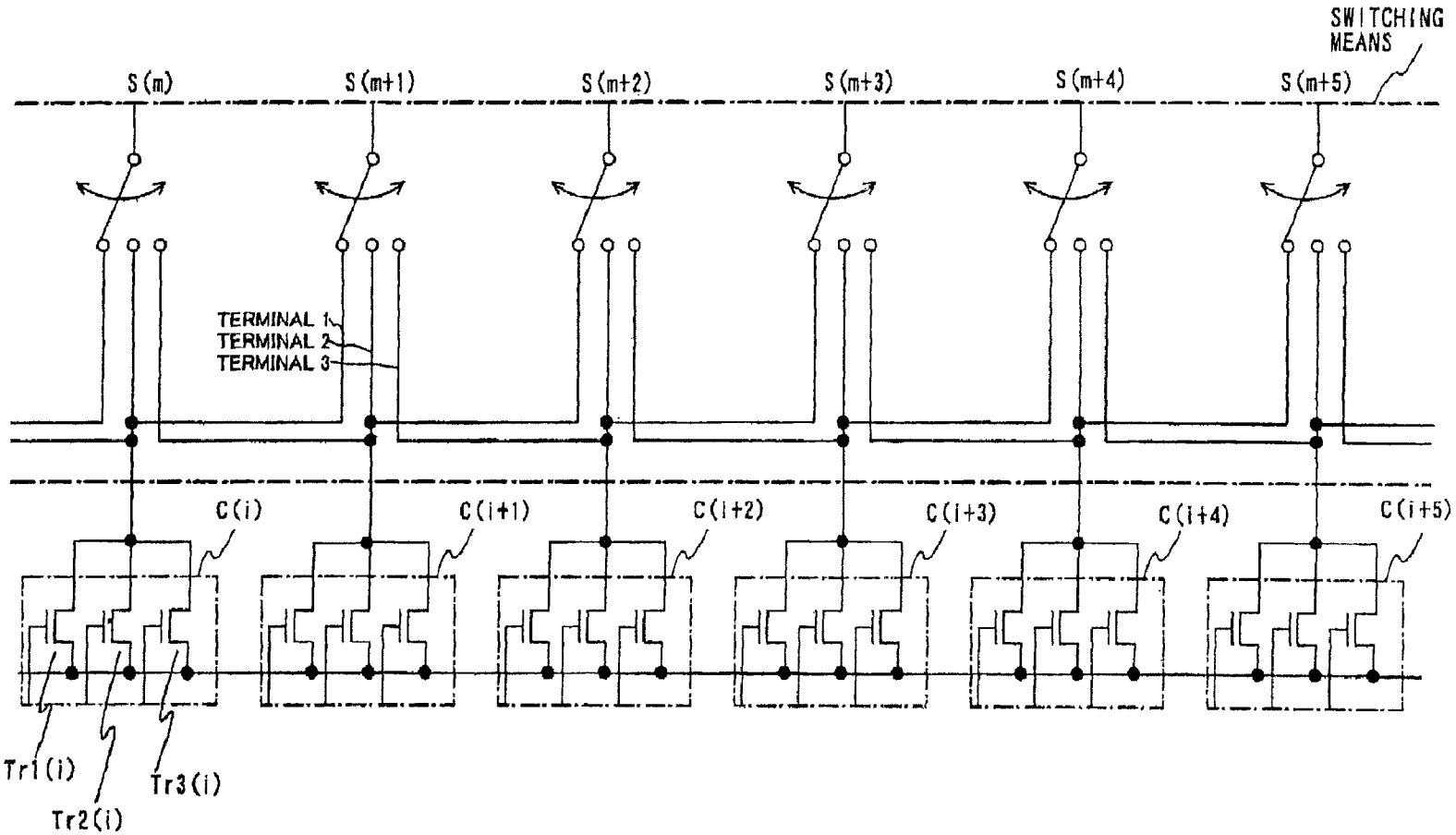
FIG. 5 is a diagram showing the structure of a semiconductor integrated circuit of the present invention.

FIG. 5 shows a specific circuit structure of such a current source circuit. As shown in FIG. 5, each current source has three transistors, Tr1(*i*), Tr2(*i*), and Tr3(*i*). The ratio of W (gate width)/L (gate length) of the three transistors Tr1(*i*), Tr2(*i*), and Tr3(*i*) is set to 1:2:4. Then, with the same gate voltage applied to the transistors Tr1(*i*), Tr2(*i*), and Tr3(*i*), the ratio of currents flowing in the transistors is 1:2:4. In short, the ratio of currents supplied from one current source is 1:2:4 and the amount of current can be controlled in $2^3=8$ stages. Accordingly, the current source circuit can output a current having analog values of 8 gray scales from a 3-bit digital video signal.

Which of the transistors Tr1(*i*), Tr2(*i*), and Tr3(*i*) will be turned ON or OFF is controlled by controlling the voltage applied to their gates. This way the current value of currents outputted from the current sources C(i) to C(i+5) can be controlled. However, combinations of the currents from the current sources C(i) to C(i+5) and the signal lines S(m) to S(m+5) are varied by the switching means. Therefore voltages applied to the transistors Tr1(*i*), Tr2(*i*), and Tr3(*i*) of each of the current sources C(i) to C(i+5) have to be switched in accordance with a switch in combination.

By giving a current source a DA conversion function as above, an image can be displayed in gray scales with high accuracy. The bit number can be set to suit individual cases and transistors are designed in accordance with the set bit number.

In a light emitting device that uses the above-described signal line driving circuit of the present invention, display unevenness of pixels is reduced visually and the light emitting device can display a uniform image having no unevenness. The present invention can provide a uniform image with no display unevenness also when a signal is inputted through an external circuit to a signal line if the present invention is applied to the external circuit.

Furthermore, the present invention makes it possible to reduce the size and weight of a light emitting device if semiconductor elements of its signal line driving circuit are polysilicon transistors. This is because polysilicon transistors can be used for semiconductor elements of a pixel portion thereof and accordingly the pixel portion and a peripheral circuit portion that includes the signal line driving circuit can be formed integrally on the same substrate. When a pixel portion and a peripheral circuit portion are integrally formed on the same substrate, no external circuit is necessary. Since complex processes for connecting an external circuit to signal lines and failed connection can be avoided, the reliability of the light emitting device is improved by the present invention.

Embodiment 2

In the present invention, the number of current sources (columns of current sources) or the position of current sources (current source column number) may be asymmetric as long as one signal line is connected to 2 or more current sources. This embodiment shows as examples different structures for connection between switching units of switching means, signal lines, and current sources than Embodiment 1.

Figure 8:
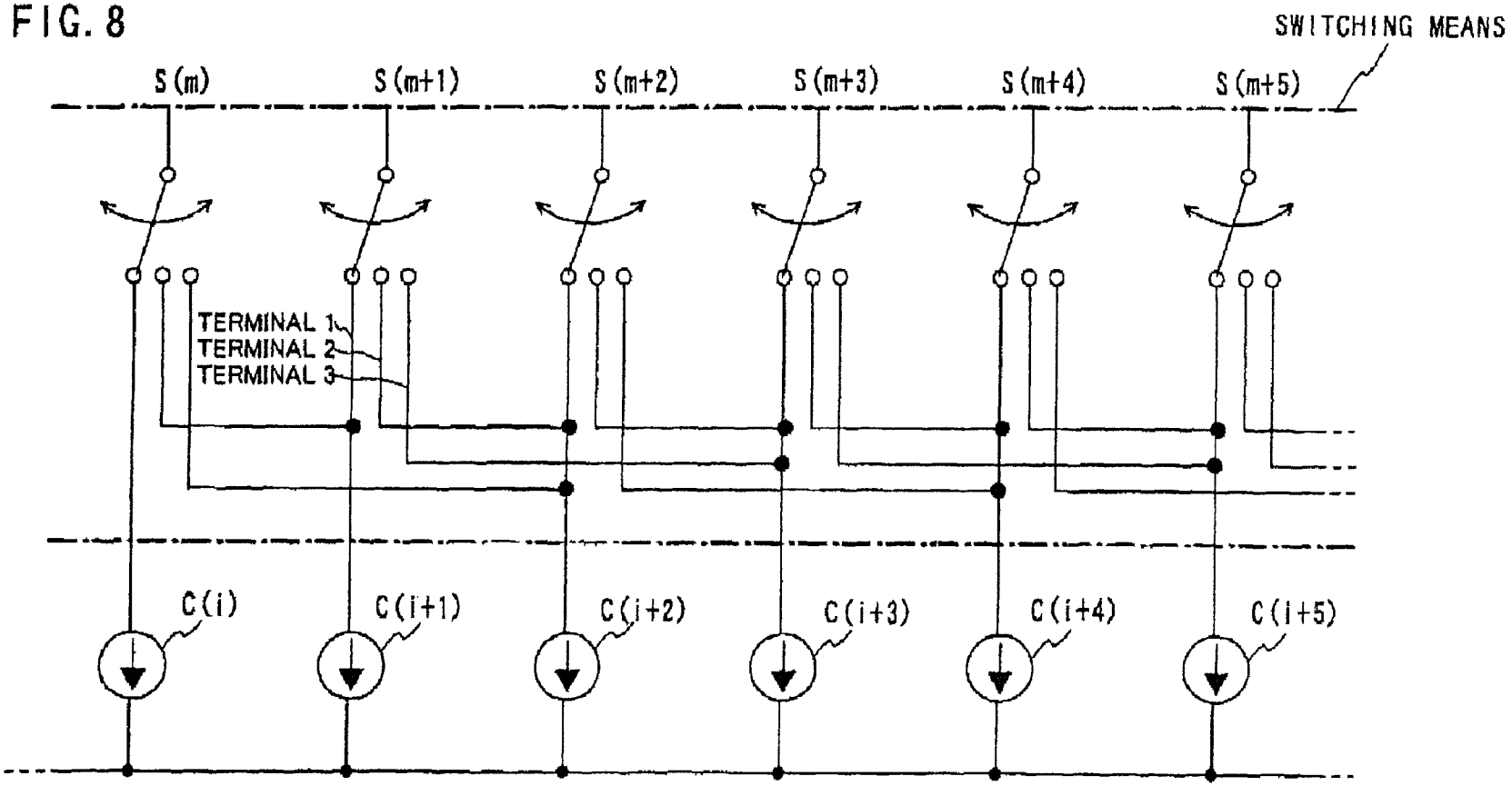
FIG. 8 is a diagram showing the structure of a semiconductor integrated circuit of the present invention.

FIG. 8 shows a structure in which current sources C(i) to C(i+5) are connected to signal lines S(m) to S(m+5) through switching means. Switching means of the present invention has a function of switching currents sent from current sources. In order to avoid complicating the drawing, the switching function is schematically illustrated in FIG. 8 to give only 3 terminals and switches.

For instance, the signal line S(m+2) can be connected to any one of the current sources C(i+2), C(i+3), and C(i+4). In short, one signal line can be connected to the closest current source and 2 adjacent current sources to the right of the closest current source. This rule is used to connect the rest of the signal lines, S(m), S(m+1), S(m+3), S(m+4), and S(m+5) to the current sources.

To generalize this connection using the function that expresses the present invention, the current sources are set so as to satisfy F1(N)=N+a, F2(N)=N+b, and F3(N)=N+c (a, b, and c are integers and a≠b≠c) when i=3, and a=−2, b=−1, and c=0.

According to the connection relation between signal lines and current sources of the present invention, it is not always necessary to connect a signal line with the closest current source, namely, a current source in the closest column, but a signal line may be connected to a distant current source. A connection structure shown in FIG. 9 is given an example thereof.

Figure 9:
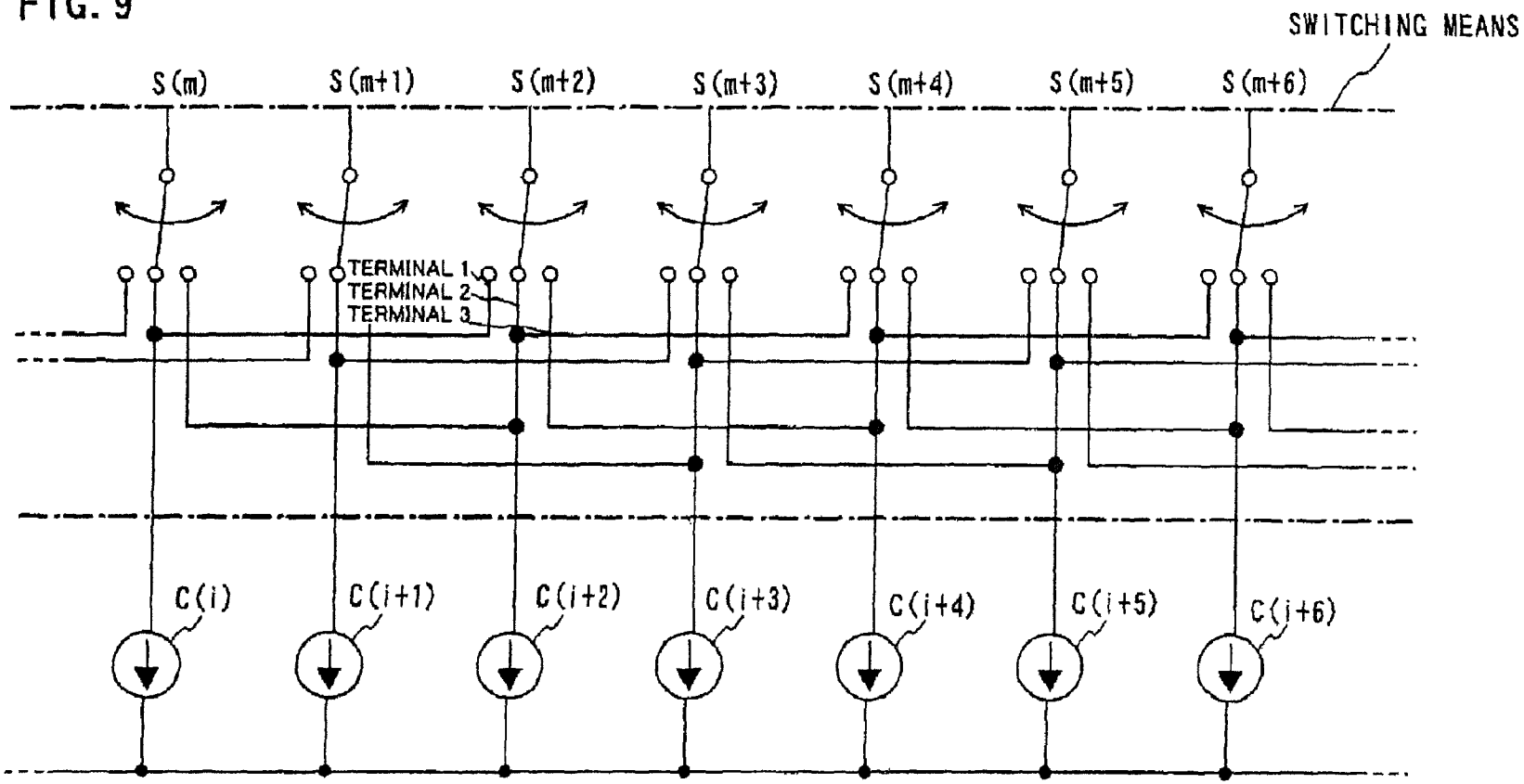
FIG. 9 is a diagram showing the structure of a semiconductor integrated circuit of the present invention.

In FIG. 9, current sources C(i) to C(i+6) are connected to signal lines S(m) to S(m+6) through switching means. This switching means too has 3 terminals and switches.

For instance, the signal line S(m+2) can be connected to any one of the current sources C(i), C(i+2), and C(i+4). In short, one signal line can be connected to the closest current source and to the current source the second from the closest current source on each side. This rule is used to connect the rest of the signal lines, S(m), S(m+1), S(m+3), S(m+4), S(m+5), and S(m+6) to the current sources.

To generalize this connection using the function that expresses the present invention, the current sources are set so as to satisfy F1(N)=N+a, F2(N)=N+b, and F3(N)=N+c (a, b, and c are integers and a≠b≠c) when i=3, and a=−2, b=0, and c=−2.

Figure 10:
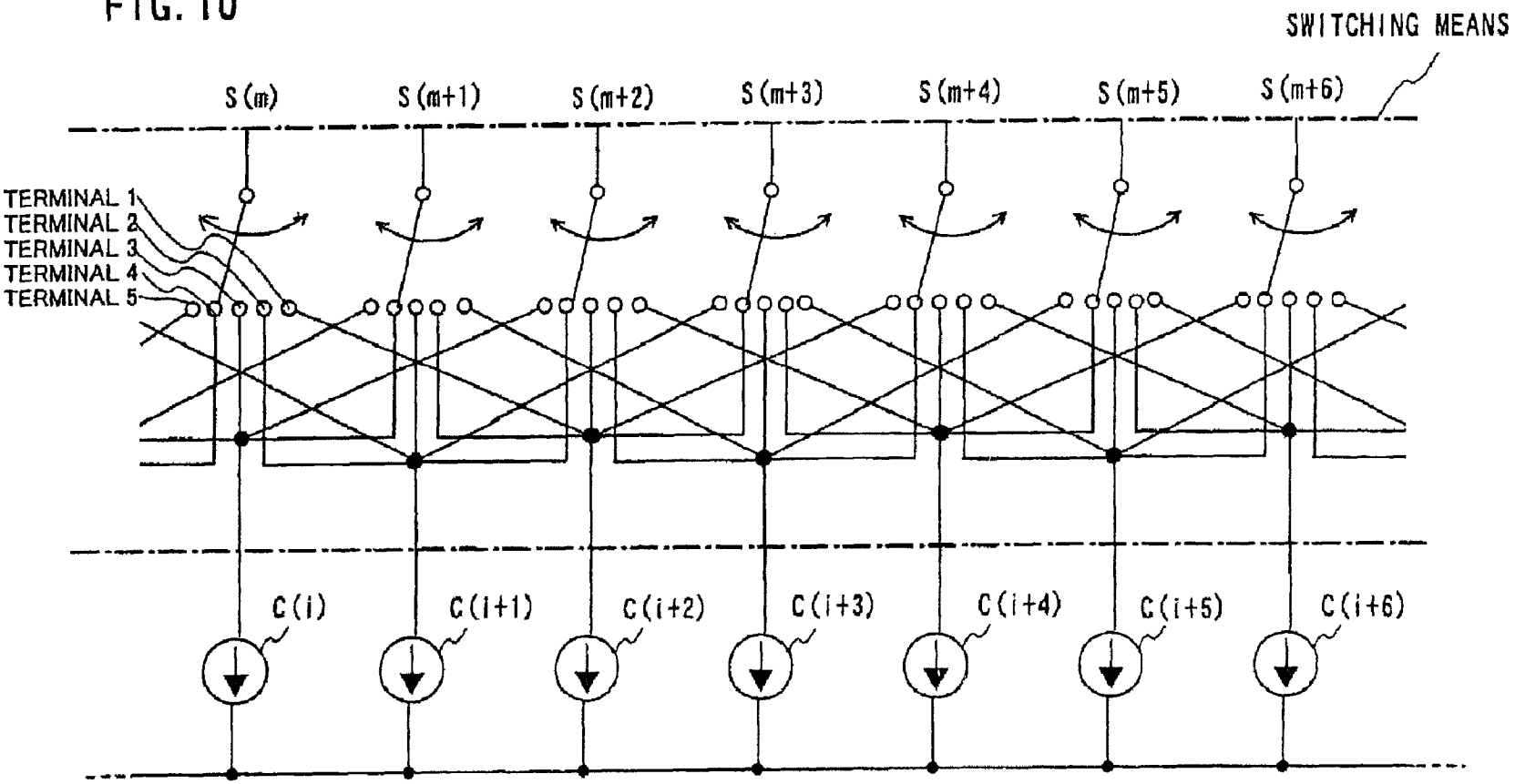
FIG. 10 is a diagram showing the structure of a semiconductor integrated circuit of the present invention.

According to the connection relation between signal lines and current sources of the present invention, the number of current sources connected to one signal line is not limited to 3. FIG. 10 shows an example of connecting 5 current sources in one switching unit.

In FIG. 10, current sources C(i) to C(i+6) are connected to signal lines S(m) to S(m+6) through switching means. A switching unit in this switching means has 5 terminals and switches.

For instance, the signal line S(m+2) can be connected to any one of the current sources C(i), C(i+1), C(i+2), C(i+3), and C(i+4). In short, one signal line can be connected to the closest current source and to 2 adjacent current sources on each side. This rule is used to connect the rest of the signal lines, S(m), S(m+1), S(m+3), S(m+4), and S(m+5) to the current sources.

To generalize this connection using the function that expresses the present invention, the current sources are set so as to satisfy F1(N)=N+a, F2(N)=N+b, F3(N)=N+c, F4(N)=N+d, F5(N)=N+c (a, b, c, d, and e are integers and a≠b≠c≠d≠e) when i=5, and a=−2, b=−1, c=0, d=1, and e=2.

A displayed image seems more uniform and unevenness is reduced more as the number of current sources that can be connected to one signal line is larger as in FIG. 10.

In this embodiment, currents flowing into signal lines can be switched by the method described in Embodiment 1 which uses analog switches to switch current sources. This embodiment may also employ current sources that have a DA conversion function (see Embodiment 1 for details). In short, this embodiment can be combined with the switching means and current sources of Embodiment 1.

As described above, the connection relation between signal lines and current sources of the present invention allows current sources to be in asymmetric number and position as long as one signal line is connected to 2 or more current sources and currents flowing into signal lines can be switched.

Embodiment 3

This embodiment describes an example in which a light emitting device of the present invention displays an image in gray scales by dividing one frame period (a unit frame period associated with synchronization timing of a video signal inputted) into, sub-frame periods (this display method is called time ratio gray scale driving display).

Time ratio gray scale driving display is explained first. In a time ratio gray scale driving method using a digital video signal (digital driving), a writing period Ta and a display period (also called a lighting period) Ts are alternately repeated in one frame period to display one image.

For example, when an image is displayed from an n-bit digital video signal, one frame period has at least n writing periods and n display periods. The n writing periods are respectively associated with n bits of the video signal and the same applies to the n display periods.

Figure 11A:
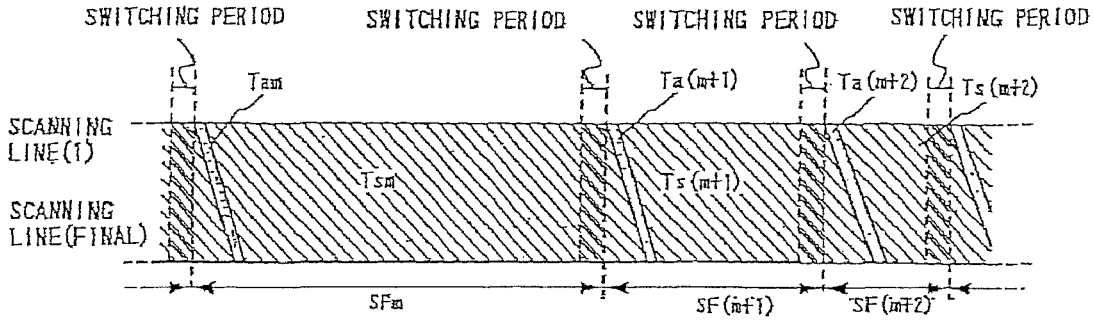
FIGS. 11A to 11C are timing charts of a signal line driving method of the present invention.

As shown in FIG. 11A, a writing period Tam (m is an arbitrary number ranging from 1 to n) is followed by a display period that is associated with the same bit number, in this case, a display period Tsm. One writing period Ta and one display period Ts constitute a sub-frame period SF. The sub-frame period consisting of the writing period Tam and the display period Tsm which are associated with the m-th bit is SFm. Lengths of the display periods Ts1 to Tsn are set so as to satisfy Ts1:Ts2: . . . :Tsn=$2^0$:$2^1$: . . . :$2^{(n-1)}$.

In each sub-frame period, whether or not a light emitting element emits light is decided based on the bit of the digital video signal. The sum of lengths of display periods in one frame period in which a light emitting element emits light is controlled to control the gray scale number.

In order to improve the quality of an image displayed, a sub-frame period having a long display period may be divided into several periods. For a specific dividing method, see Japanese Patent Application No. 2000-267164.

In this embodiment, it is desirable to switch currents flowing from current sources to signal lines in a display period of a sub-frame period. If the switch is made in a writing period, the inputted current, namely, information on whether or not a light emitting element is to emit light, may not be transferred successfully. By switching in such short a period at intervals, fluctuation in luminance of light emitting elements is further reduced and the uniformity in display is improved.

Figure 11B:
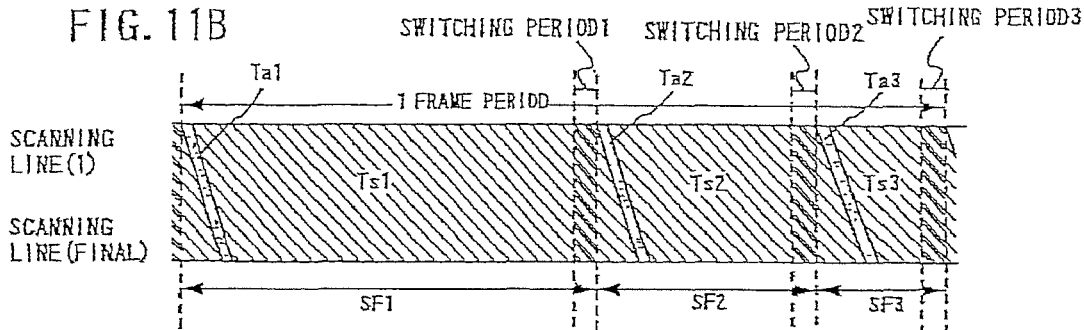

FIG. 11B shows a specific example in which a 3-bit signal is used. In FIG. 11B, one frame period has sub-frame periods SF1, SF2, and SF3. The sub-frame periods SF1, SF2, and SF3 have writing periods Ta1, Ta2, and Ta3 and display periods Ts1, Ts2, and Ts3, respectively. Periods in which connection between a signal line and a current source is switched (hereinafter simply referred to as switching periods) 1, 2, and 3 are provided in display periods Ts1, Ts2, and Ts3, respectively. Currents inputted from current sources to signal lines are switched in the switching periods 1 to 3. In this way, the switch can be made in a short period at intervals and a displayed image seems more uniform.

The switching periods 1 to 3 in FIG. 11B are each put immediately before a writing period. However, a switching period can be set in any time frame as long as it is within a display period.

Figure 11C:
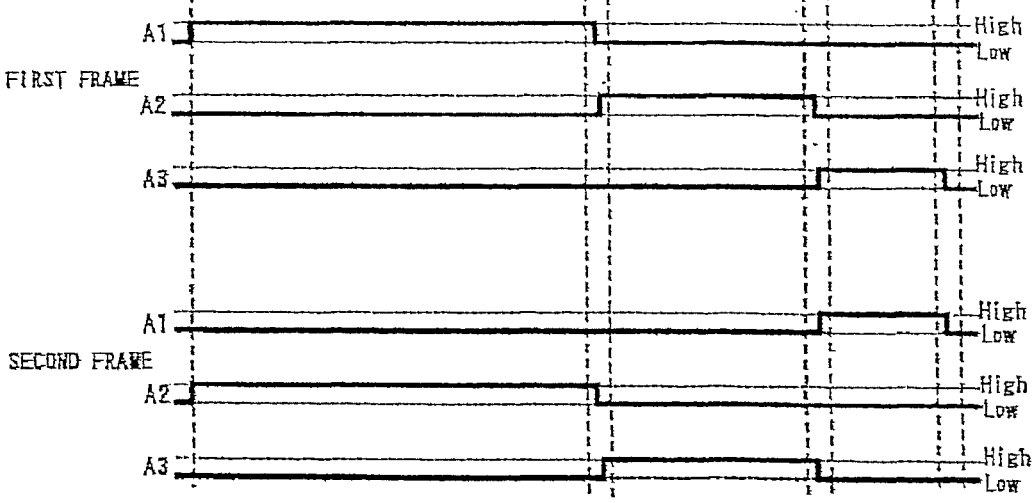

FIG. 11C is a timing chart of signals inputted to analog switches. In the first frame, A1 is ON in SF1, A2 is ON in SF2, and A3 is ON in SF3. In the second frame, A2 is ON in SF1, A3 is ON in SF2, and A1 is ON in SF3. Though not shown in FIG. 11C, it is similar for the third frame and A3 is ON in SF1, A1 is ON in SF2, and A2 is ON in SF3.

If ON states of A1 to A3 in the sub-frame periods SF1 to SF3 are fixed (if A1 is ON in SF1, A2 is ON in SF2, and A3 is ON in SF3 throughout the first to third frames), fluctuation cannot be evened out sufficiently. Accordingly, as shown in FIG. 11C, it is desirable to vary their ON states from one sub-frame period to another and from one frame period to another.

This embodiment is merely an example and which signal is inputted in which sub-frame period can be set to suit individual cases. For a specific method of inputting signals, see FIG. 4.

In this embodiment, it is preferable to employ the current source circuits of Embodiment 1 which have a DA conversion function in order to raise the gray scale number. This embodiment can be combined with Embodiments 1 and 2.

Embodiment 4

Figure 12A:
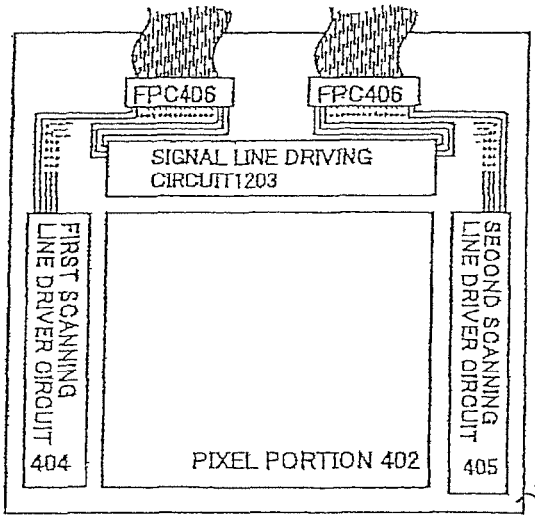
FIGS. 12A and 12B are diagrams showing the structure of a light emitting device of the present invention.

This embodiment describes the structure of a light emitting device of the present invention with reference to FIG. 12.

The light emitting device of the invention includes a pixel portion 402 having a plurality of pixels arranged in matrix on a substrate 401, and includes a signal line driving circuit 1203, a first scanning line driver circuit 404 and a second scanning line driver circuit 405 in the periphery of the pixel portion 402. Although the signal line driving circuit 1203 and the two scanning line driver circuits 404 and 405 are provided in FIG. 12(A), the present invention is not limited thereto, and may be arbitrarily designed depending on the pixel structure. Signals are supplied from the outside to the signal line driving circuit 1203, the first scanning line driver circuit 404 and the second scanning line driver circuit 405 via FPCs 406.

Figure 12B:
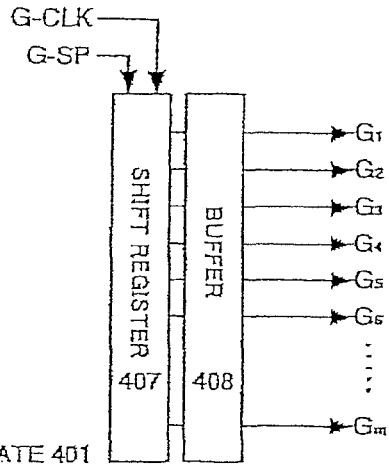

The structures and operations of the first scanning line driver 404 circuit and the second scanning line driver circuit 405 will be described using FIG. 12(B). The first scanning line driver 404 circuit and the second scanning line driver circuit 405 each include a shift register 407 and a buffer 408. Operations will be briefly described as: the shift register 407 sequentially outputs sampling pulses in accordance with a clock signal (G-CLK), a start pulse (S-SP), and an inverted clock signal (G-CLKb); thereafter, the sampling pulses amplified in the buffer 408 are input to scanning lines; and the scanning lines are set to be in a selected state for each line; signal currents $I_{data}$ are sequentially written to pixels controlled by the selected signal lines.

Note that the structure may be such that a level shifter circuit is arranged between the shift register 407 and the buffer 408. Disposition of the level shifter circuit enables the voltage amplitude to be increased.

The structure of the signal line driving circuit 1203 will be hereafter described. Note that this embodiment may be arbitrarily combined with Embodiment 1, 2 and 3.

Current sources provided in the signal line driving circuit of the invention may not be arranged in a straight line, but may be shifted and arranged. Further, two signal line driving circuits may be provided symmetrical to the pixel portion. That is to say, the present invention does not limit the arrangement of the current sources as long as the current sources connect to the signal lines via switching means.

Embodiment 5

In this embodiment, the detailed structure and operations of the signal line driving circuit 1203 used in the case of performing 1-bit digital gradation display will be described with reference to FIG. 13.

Figure 13A:
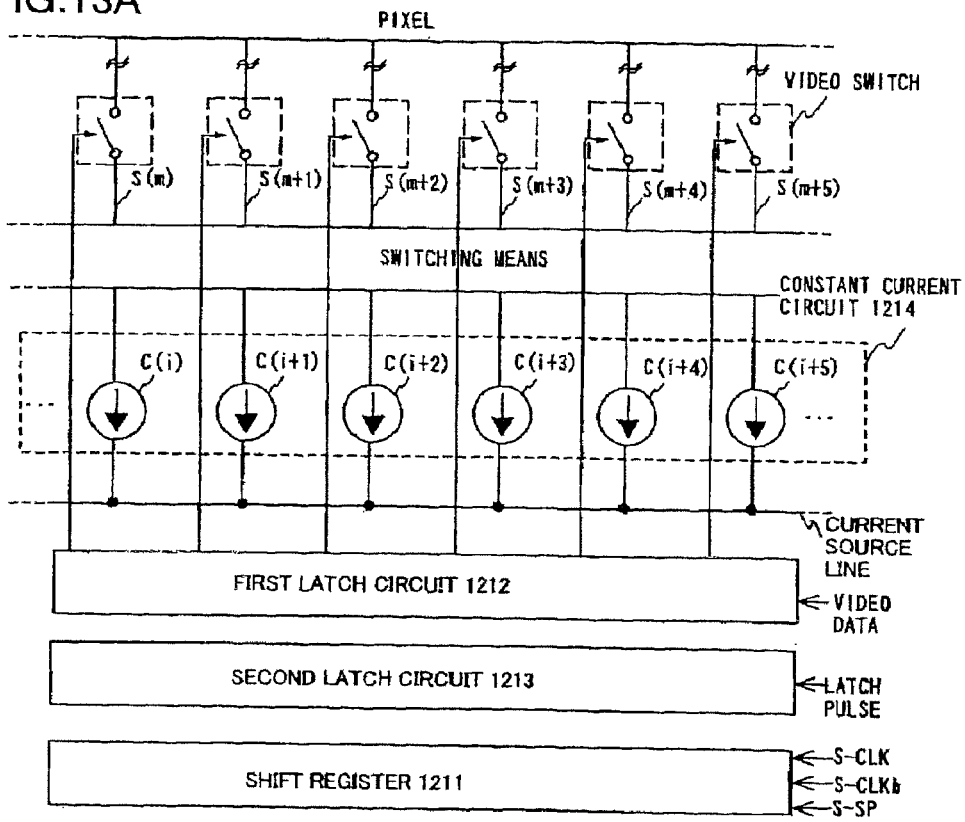
FIGS. 13A and 13B are diagrams showing the structure of a semiconductor integrated circuit of the present invention.

FIG. 13(A) is a schematic view of the signal line driving circuit 1203 used in the case of performing 1-bit digital gradation display. The signal line driving circuit 1203 includes a shift register 1211, a first latch circuit 1212, a second latch circuit 1213 and a constant current circuit 1214. The shift register 1211, the first latch circuit 1212 and the second latch circuit 1213 function as switches used for the video signals shown in FIG. 1.

Figure 13B:
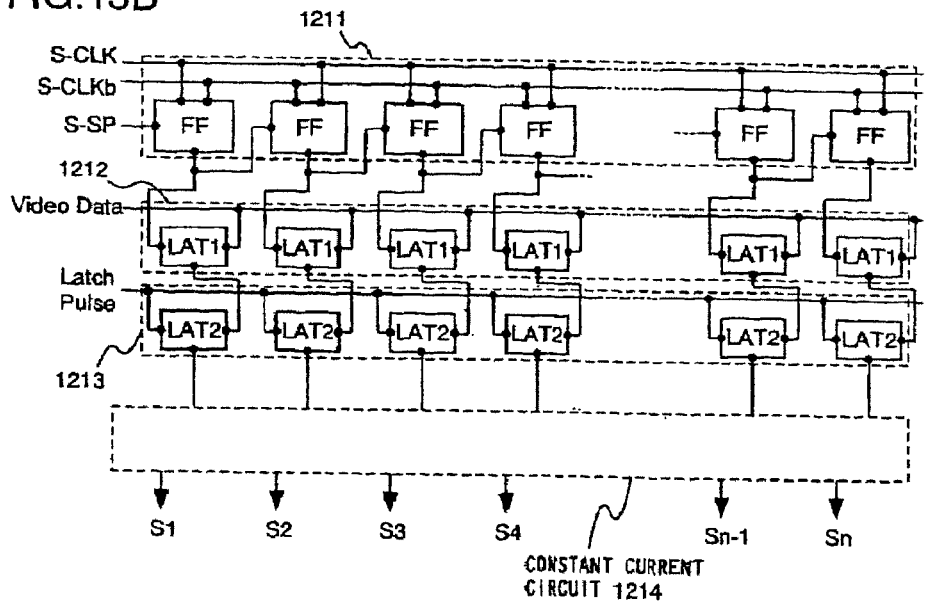
Figure 14:
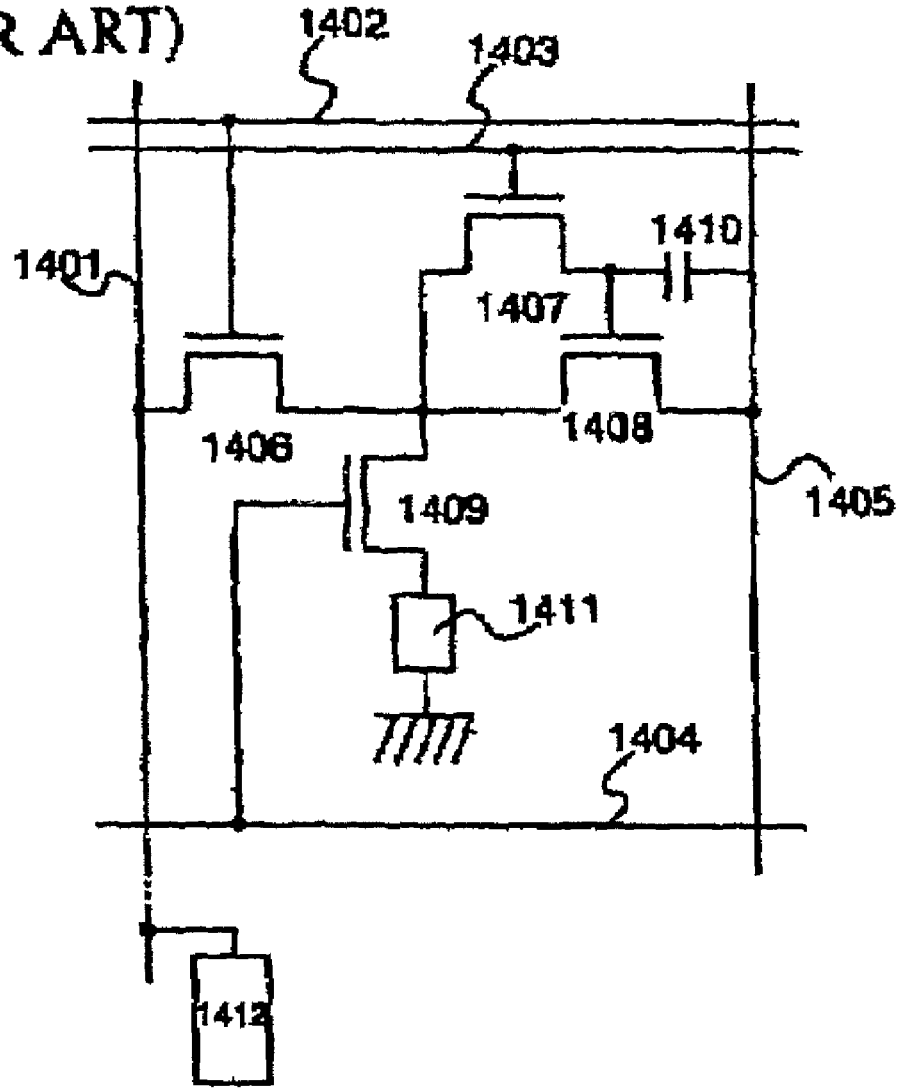
FIG. 14 (PRIOR ART)
FIG. 14 is a circuit diagram of a pixel of a light emitting device.

Further, the constant current circuit 1214 is constituted by a plurality of current sources. FIG. 13(B) shows specific circuits of the shift register 1211, the first latch circuit 1212 and the second latch circuit 1213.

Operations will be briefly described. The shift register 1211 is constituted by, for example, a plurality of flip-flop circuits (FFs). A clock signal (S-CLK), a start pulse (S-SP) and an inverted clock signal (S-CLKb) are input therein, and sampling pulses are sequentially output in accordance with the timing of these signals.

The sampling pulses, which have been output from the shift register 1211, are input to the first latch circuit 1212. Digital video signals have been input to the first latch circuit 1212, and a video signal is retained in each column in accordance with the input timing of the sampling pulse.

In the first latch circuit 1212, upon completion of video-signal retaining operations in columns to the last column, during a horizontal return period, a latch pulse is input to the second latch circuit 1213, and video signals retained in the first latch circuit 1212 are transferred in batch to the second latch circuit 1213. As a result, one-line video signals retained in the second latch circuit 1213 are input to video switches at the same time. On-off operations of the video switches are carried out to control the input of the signals to the pixels, thereby displaying the gradation.

While the video signals retained in the second latch circuit 1213 are being supplied to the constant current circuit 1214, sampling pulses are again output in the shift register 1211. Thereafter, the operation is iterated, and one-frame video signals are processed.

In addition, Embodiment 5 can be arbitrarily combined with the inventions described in embodiments 1, 2, 3 and 4.

Embodiment 6

Electronic equipment using the light emitting device of the present invention includes, for example, video cameras, digital cameras, goggle type displays (head mount displays), navigation systems, audio reproducing devices (such as car audio and audio components), notebook personal computers, game machines, mobile information terminals (such as mobile computers, mobile phones, portable game machines, and electronic books), and image reproducing devices provided with a recording medium (specifically, devices for reproducing a recording medium such as a digital versatile disc (DVD), which includes a display capable of displaying images). In particular, in the case of mobile information terminals, since the degree of the view angle is appreciated important, the terminals preferably use the light emitting device. Practical examples are shown in FIG. 15.

Figure 15A:
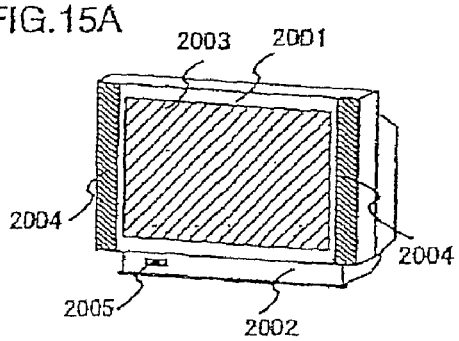
FIGS. 15A to 15H are diagrams showing electronic equipment to which a light emitting device of the present invention is applied.

FIG. 15(A) shows a light emitting device, which contains a casing 2001, a support base 2002, a display portion 2003, a speaker portion 2004, a video input terminal 2005, and the like. The light emitting device of the present invention can be applied to the display portion 2003. Further, the light emitting device shown in FIG. 15(A) is completed with the present invention. Since the light emitting device is of self-light emitting type, it does not need a back light, and therefore a display portion that is thinner than that of a liquid crystal display can be obtained. Note that light emitting devices include all information display devices, for example, personal computers, television broadcast transmitter-receivers, and advertisement displays.

Figure 15B:
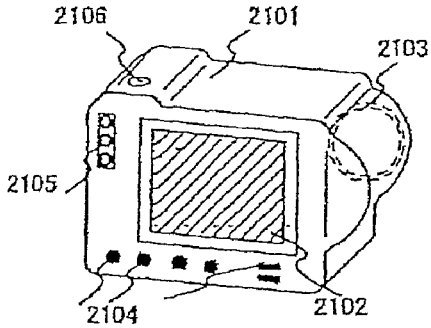

FIG. 15(B) shows a digital still camera, which contains a main body 2101, a display portion 2102, an image receiving portion 2103, operation keys 2104, an external connection port 2105, a shutter 2106, and the like. The light emitting device of the present invention can be applied to the display portion 2102. Further, the digital still camera shown in FIG. 15(B) is completed with the present invention.

Figure 15C:
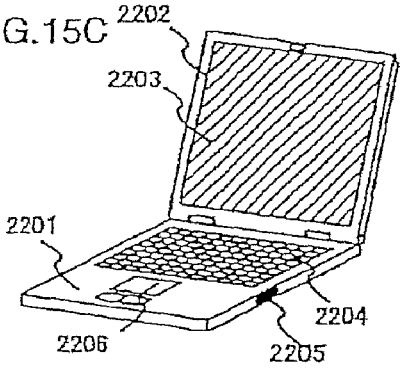

FIG. 15(C) shows a notebook personal computer, which contains a main body 2201, a casing 2202, a display portion 2203, a keyboard 2204, external connection ports 2205, a pointing mouse 2206, and the like. The light emitting device of the present invention can be applied to the display portion 2203. Further, the light emitting device shown in FIG. 15(C) is completed with the present invention.

Figure 15D:
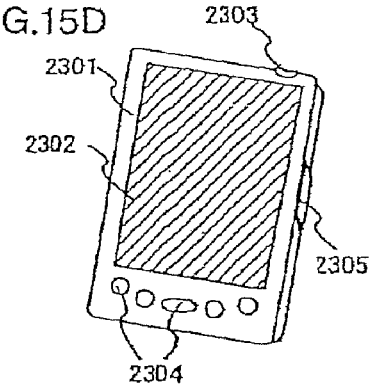

FIG. 15(D) shows a mobile computer, which contains a main body 2301, a display portion 2302, a switch 2303, operation keys 2304, an infrared port 2305, and the like. The light emitting device of the present invention can be applied to the display portion 2303. Further, the mobile computer shown in FIG. 15(D) is completed with the present invention.

Figure 15E:
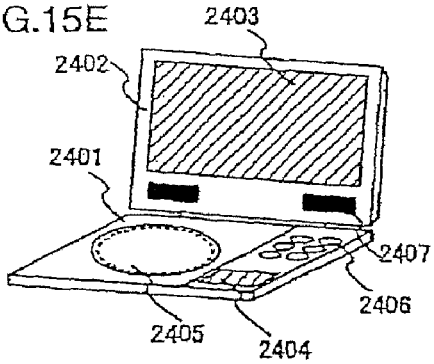

FIG. 15(E) shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The light emitting device of the present invention can be used in the display portion A 2403 and in the display portion B 2404. Note that family game machines and the like are included in the image reproducing devices provided with a recording medium. Further, the DVD reproducing device shown in FIG. 15(E) is completed with the present invention.

Figure 15F:
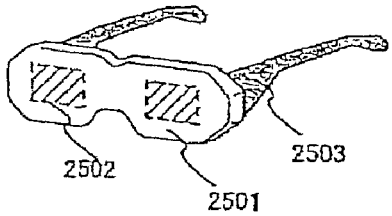

FIG. 15(F) shows a goggle type display (head mounted display), which contains a main body 2501, a display portion 2502, an arm portion 2503, and the like. The light emitting device of the present invention can be used in the display portion 2502. The goggle type display shown in FIG. 15(F) is completed with the present invention.

Figure 15G:
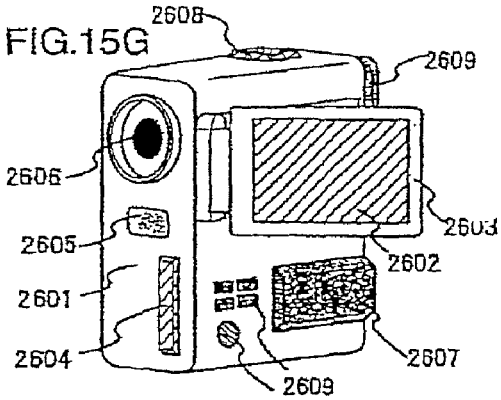

FIG. 15(G) shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The light emitting device of the present invention can be used in the display portion 2602. The video camera shown in FIG. 15(G) is completed with the present invention.

Figure 15H:
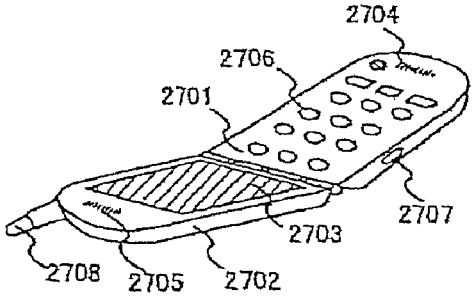

Here, FIG. 15(H) shows a mobile phone, which contains a main body 2701, a casing 2702, a display portion 2703, an audio input portion 2704, an audio output portion 2705, operation keys 2706, external connection ports 2707, an antenna 2708, and the like. The light emitting device of the present invention can be used in the display portion 2703. Note that, by displaying white characters on a black background, the current consumption of the mobile phone can be suppressed. Further, the mobile phone shown in FIG. 15(H) is completed with the present invention.

When the emission luminance of light emitting materials are increased in the future, the light emitting device will be able to be applied to a front or rear type projector by expanding and projecting light containing image information having been output lenses or the like.

Cases are increasing in which the above-described electronic equipment displays information distributed via electronic communication lines such as the Internet and CATVs (cable TVs). Particularly increased are cases where moving picture information is displayed. Since the response speed of the light emitting materials is very high, the light emitting device is preferably used for moving picture display.

Since the light emitting device consumes power in a light emitting portion, information is desirably displayed so that the light emitting portions are reduced as much as possible. Thus, in the case where the light emitting device is used for a display portion of a mobile information terminal, particularly, a mobile phone, an audio playback device, or the like, which primarily displays character information, it is preferable that the character information be formed in the light emitting portions with the non-light emitting portions being used as the background.

As described above, the application range of the present invention is very wide, so that the invention can be used for electronic equipment in all of fields. The electronic equipment according to this embodiment may use the structure of the signal line driving circuit according to any one of Embodiments 1 to 5.

The present invention can provide a semiconductor integrated circuit in which influence of characteristic fluctuation between transistors in a current source circuit is reduced until the transistor characteristics do not affect the circuit, and a method of driving the semiconductor integrated circuit. The semiconductor integrated circuit of the present invention can be used in a driving circuit portion to provide a light emitting device having a pixel portion. In particular, the semiconductor integrated circuit of the present invention can be applied to a signal line driving circuit of a driving circuit portion to provide an active matrix light emitting device in which pixels are arranged so as to form a matrix pattern and each of the pixels has a switching element and a light emitting element. The present invention can also provide a light emitting device in which elements of a pixel portion and a driving circuit portion are polysilicon thin film transistors to integrally form the pixel portion and the driving circuit portion on the same substrate.

What is claimed is:

1. A display comprising:

a pixel portion over a substrate;

m signal lines $S_1, S_2, \ldots$, and $S_m$;

a plurality of scanning lines extending across said m signal lines on the pixel portion;

a signal source circuit over the substrate, the signal source circuit including i signal sources $C_1, C_2, \ldots$, and $C_i$; and a switching circuit comprising n switching units $U_1, U_2, \ldots$, and $U_n$, wherein one of the signal lines is connectable to at least three of the signal sources through one of the switching units, but electrically connected to only one of said at least three of the signal sources at a time, wherein at least a first signal line and a second signal line of the m signal lines are connectable to at least a same one of the signal sources, and wherein the first signal line is connectable to at least one signal source to which the second signal line is not connectable.

2. A display according to claim 1, further comprising a first latch circuit, a second latch circuit, and a shift register, the second latch circuit being connected to the first latch circuit, the shift register being connected to the second latch circuit.

3. A display according to claim 1, wherein the signal sources each comprise a transistor.

4. A display according to claim 3, wherein the transistor comprises a polysilicon thin film transistor.

5. A display according to claim 1, wherein the signal sources each comprise a plurality of transistors, and wherein the ratio of the gate length to the gate width is the same in all of the plurality of transistors.

6. A display according to claim 1, wherein the switching units are composed of analog switches.

7. The display according to claim 1, wherein said display comprises a light emitting device.

8. A method of driving a display, comprising:

a pixel portion over a substrate;

m signal lines $S_1, S_2, \ldots$, and $S_m$;

a plurality of scanning lines extending across said m signal lines on the pixel portion;

a signal source circuit over the substrate, the signal source circuit including i signal sources $C_1, C_2, \ldots$, and $C_i$; and a switching circuit comprising n switching units $U_1, U_2, \ldots$, and $U_n$, wherein one of the signal lines is connectable to at least three of the signal sources through one of the switching units, but electrically connected to only one of said at least three of the signal sources at a time, and wherein said one of the n switching units switches a connection of said one of the m signal lines to said at least three of the i signal sources, wherein at least a first signal line and a second signal line of the m signal lines are connectable to at least a same one of the signal sources, and wherein the first signal line is connectable to at least one signal source to which the second signal line is not connectable.

9. A display, comprising:

a pixel portion over a substrate;

a first signal line and a second signal line next to the first signal line;

a plurality of scanning lines extending across the first signal line and the second signal line on the pixel portion;

a signal source circuit over the substrate, the signal source circuit including a first signal source, a second signal source, a third signal source, a fourth signal source, and a fifth signal source; and a switching circuit comprising n switching units $U_1$, $U_2$, . . . , and $U_n$, wherein the first signal line is connectable to the first signal source, the second signal source and the fourth signal source through the switching circuit, but electrically connected to only one of the first signal source, the second signal source and the fourth signal source at a time, wherein the second signal line is connectable to the second signal source, the third signal source and the fifth signal source through the switching circuit, but electrically connected to only one of the second signal source, the third signal source and the fifth signal source at a time, wherein the first signal line is not connectable to the third signal source, and wherein the second signal line is not connectable to the first signal source.

10. A display according to claim 9, further comprising a first latch circuit, a second latch circuit, and a shift register, with the second latch circuit being connected to the first latch circuit and the shift register being connected to the second latch circuit.

11. A display according to claim 9, wherein each of the signal sources comprises a transistor.

12. A display according to claim 11, wherein the transistor comprises a polysilicon thin film transistor.

13. A display according to claim 9, wherein each of the signal sources comprises a plurality of transistors, and wherein the ratio of the gate length to the gate width is the same in all of the plural transistors.

14. A display according to claim 9, wherein the switching units are composed of analog switches.

15. The display according to claim 9, wherein said display is a light emitting device.

16. A method of driving a display, comprising:

a pixel portion over a substrate;

a first signal line and a second signal line next to the first signal line;

a plurality of scanning lines extending across the first signal line and the second signal line on the pixel portion;

a signal source circuit over the substrate, the signal source circuit including a first signal source, a second signal source, a third signal source, a fourth signal source, and a fifth signal source;

a switching circuit comprising n switching units $U_1$, $U_2$, . . . , and $U_n$;

a first latch circuit;

a second latch circuit; and a shift register, the second latch circuit being connected to the first latch circuit, the shift register being connected to the second latch circuit, wherein one of the first signal line is connectable to the first signal source, the second signal source and the fourth signal source through the switching circuit, but electrically connected to only one of the first signal source, the second signal source and the fourth signal source at a time, wherein the second signal line is connectable to the second signal source, the third signal source and the fifth signal source through the switching circuit, but electrically connected to only one of the second signal source, the third signal source and the fifth signal source at a time, wherein the first signal line is not connectable to the third signal source, wherein the second signal line is not connectable to the first signal source, wherein a selective connection of the first signal line to one of the first signal source, the second signal source and the fourth signal source is switched periodically.

17. A method of driving a display according to claim 16, wherein a unit frame period comprises m (m is a natural number equal to or larger than 2) sub-frame periods SF1, SF2, . . . , and SFm, and the m sub-frame periods SF1, SF2, . . . , and SFm comprise writing periods Ta1, Ta2, . . . , and Tam and display periods Ts1, Ts2, . . . , and Tsm, respectively.

18. A display device according to claim 1, wherein the signal source circuit is a current source circuit.

19. A method according to claim 8, wherein the signal source circuit is a current source circuit.

20. A display device according to claim 9, wherein the signal source circuit is a current source circuit.

21. A method according to claim 16, wherein the signal source circuit is a current source circuit.

* * * * *